US007974568B2

(12) United States Patent
Yamasaki et al.

(10) Patent No.: US 7,974,568 B2
(45) Date of Patent: Jul. 5, 2011

(54) IMAGE FORMING APPARATUS, CONTROLLER, COMPUTER READABLE MEDIUM AND IMAGE FORMING CONDITION ADJUSTMENT METHOD

(75) Inventors: Naoya Yamasaki, Ebina (JP); Matsuyuki Aoki, Ebina (JP); Shunichiro Shishikura, Ebina (JP); Yasunori Unagida, Ebina (JP); Satoshi Tanaka, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 674 days.

(21) Appl. No.: 12/024,279

(22) Filed: Feb. 1, 2008

(65) Prior Publication Data

US 2008/0219682 A1 Sep. 11, 2008

(30) Foreign Application Priority Data

Mar. 6, 2007 (JP) ..... 2007-055884

(51) Int. Cl.
*G03G 15/00* (2006.01)

(52) U.S. Cl. ..... 399/396; 399/27; 399/29; 399/43

(58) Field of Classification Search ..... 399/396, 399/43, 74, 27, 29
See application file for complete search history.

(56) References Cited

U.S. PATENT DOCUMENTS

| | | | | |
|---|---|---|---|---|
| 6,785,480 | B2 * | 8/2004 | Toyohara et al. | 399/49 |
| 7,177,558 | B2 * | 2/2007 | Tanaka et al. | 399/39 |
| 7,751,732 | B2 * | 7/2010 | Yokoyama | 399/39 |
| 2004/0028421 | A1 * | 2/2004 | Shiratori | 399/49 |

FOREIGN PATENT DOCUMENTS

| | | | |
|---|---|---|---|
| JP | 07-230211 | A | 8/1995 |
| JP | 2005-212457 | A | 8/2005 |

* cited by examiner

*Primary Examiner* — Matthew G Marini
(74) *Attorney, Agent, or Firm* — Sughrue Mion, PLLC

(57) ABSTRACT

An image forming apparatus is provided with: an image forming unit that forms an image on a medium according an image forming condition; a speed changing unit that changes an image forming speed of the image forming unit between a plurality of image forming speeds including a first image forming speed; an adjusting unit that adjusts the image forming condition set in the image forming unit; a measuring unit that measures an elapsed state after the image forming condition is adjusted for the last time at the first image forming speed in the image forming unit, and outputs a measured value indicative of the elapsed state; and a determination unit that determines, according to the elapsed state, whether or not to adjust the image forming condition before the image forming unit starts forming an image at the first image forming speed.

8 Claims, 16 Drawing Sheets

IMAGE FORMING APPARATUS, CONTROLLER, COMPUTER READABLE MEDIUM AND IMAGE FORMING CONDITION ADJUSTMENT METHOD

CROSS REFERENCE TO RELATED APPLICATIONS

This application is based on and claims priority under 35 USC §119 from Japanese Patent Application No. 2007-055884 filed Mar. 6, 2007.

BACKGROUND

1. Technical Field

The present invention relates to an image forming apparatus, a controller, a computer readable medium storing a program and an image forming condition adjustment method.

2. Related Art

A developing apparatus controlled so as to select a value as a reference value from a toner density storing unit in response to a change of an image forming process speed and then to adjust a toner density to the reference value is known.

SUMMARY

According to an aspect of the invention, there is provided an image forming apparatus including: an image forming unit that forms an image on a medium according an image forming condition; a speed changing unit that changes an image forming speed of the image forming unit between plural image forming speeds including a first image forming speed; an adjusting unit that adjusts the image forming condition set in the image forming unit; a measuring unit that measures an elapsed state after the image forming condition is adjusted for the last time at the first image forming speed in the image forming unit, and outputs a measured value indicative of the elapsed state; and a determination unit that determines, according to the elapsed state, whether or not to adjust the image forming condition before the image forming unit starts forming an image at the first image forming speed. The elapsed state is measured by the measuring unit at the time when the speed changing unit changes the image forming speed to the first image forming speed.

BRIEF DESCRIPTION OF THE DRAWINGS

Exemplary embodiment(s) of the present invention will be described in detail based on the following figures, wherein.

DETAILED DESCRIPTION

Hereinafter, exemplary embodiments of the present invention will be described in detail with reference to the attached drawings.

First Exemplary Embodiment

Figure 1:
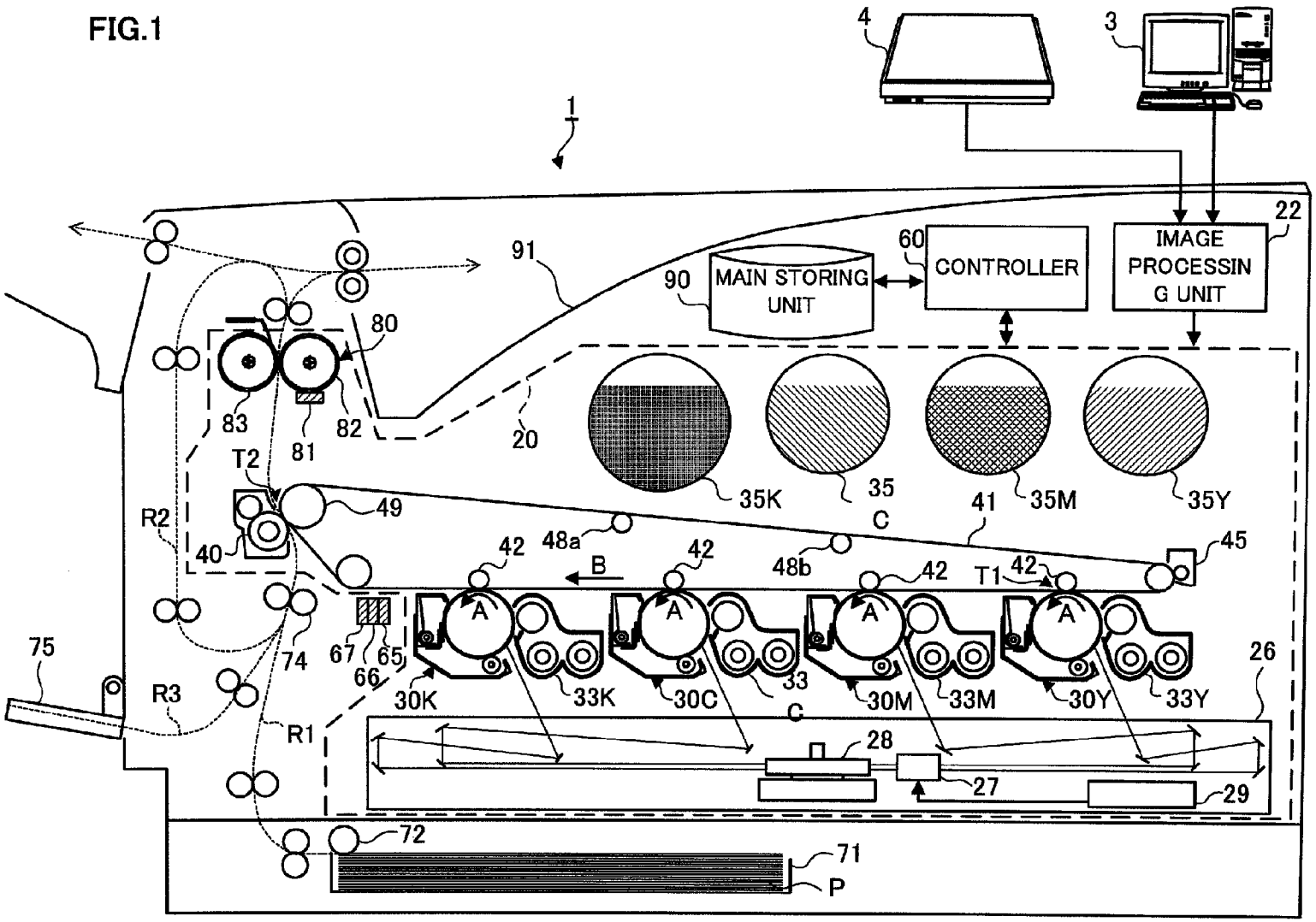
FIG. 1 is a diagram showing a configuration example of an image forming apparatus to which the first exemplary embodiment of the present invention is applied.

FIG. 1 is a diagram showing a configuration example of an image forming apparatus to which the first exemplary embodiment of the present invention is applied. An image forming apparatus 1 shown in FIG. 1 is what is termed as a tandem-type digital color printer with electrophotography, and includes an image-formation process unit 20, a controller 60, an image processing unit 22 and a main storing unit 90. Specifically, the image-formation process unit 20 forms an image in response to image data of each color and is an example of an image forming unit. The controller 60 controls the entire operations of the image forming apparatus 1. The image processing unit 22 performs a certain image processing on image data received, for example, from a personal computer (PC) 3, an image reading apparatus 4 such as a scanner and the like. The main storing unit 90 is constructed, for example, in a hard disk (hard disk drive) on which processing programs and the like are recorded.

It should be noted that, this program may be executed by loading, to a RAM, the program stored in a reserved area such as a hard disk or a DVD-ROM. In addition, another aspect of this program may be executed by a CPU while being prestored in a ROM. Moreover, when an apparatus is provided with a rewritable ROM such as an EEPROM, only this program is sometimes provided and installed in the ROM after the assembling of the apparatus is completed. In addition, this program may also be transmitted to an apparatus through a network such as the Internet and then installed in a ROM included in the apparatus, whereby the program is provided.

Moreover, the image forming apparatus 1 also includes a reference density detection sensor 55, a humidity sensor 56 that detects the humidity inside the apparatus, and a temperature sensor 57 that detects the temperature inside the apparatus. The reference density detection sensor 55 detects a toner image density, which is an example of state quantities, that is, the toner image density of each of reference density patterns made of toner images of each color formed on an intermediate transfer belt 41, which will be described later.

The image-formation process unit 20 includes four image forming units 30Y, 30M, 30C and 30K (each of the four image forming units 30Y, 30M, 30C and 30K is also referred to as an image forming unit 30 with no distinction in the colors) arranged in parallel at certain intervals. The image forming unit 30 is an example of a image forming unit that forms toner images of each of yellow (Y), magenta (M), cyan (C) and black (K).

Figure 2:
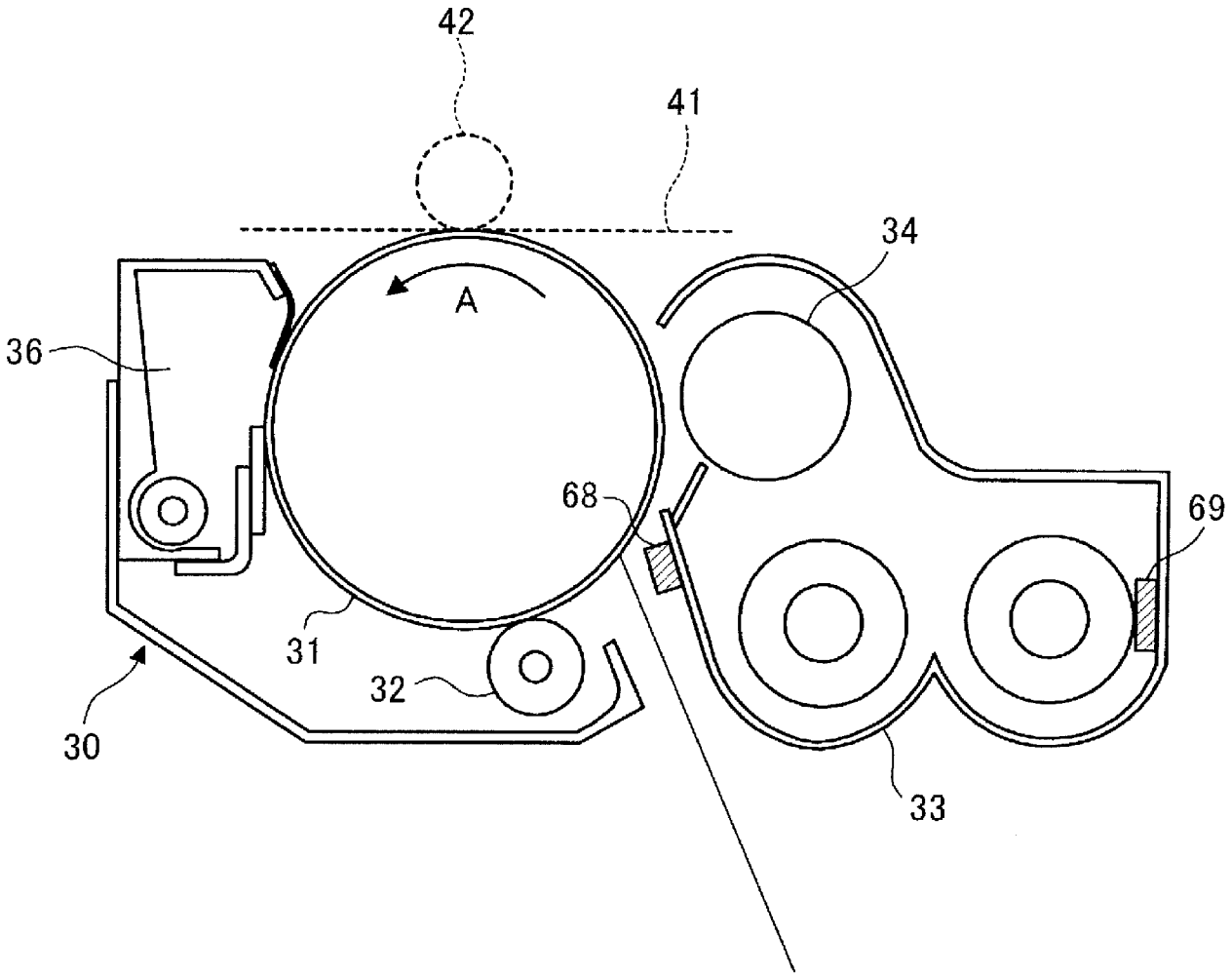
FIG. 2 is a diagram showing a configuration example of the image forming unit.

Here, FIG. 2 is a diagram showing a configuration example of the image forming unit 30. As shown in FIG. 2, the image forming unit 30 includes a photosensitive drum 31, a charging roll 32, a developing unit 33 and a drum cleaner 36. The photosensitive drum 31 is an example of an image carrier that has an electrostatic latent image formed thereon while rotating in a direction of an arrow A. The charging roll 32 uniformly charges the surface of the photosensitive drum 31 at a certain electric potential. The developing unit 33 develops electrostatic latent images formed on the photosensitive drum 31. The drum cleaner 36 cleans the surface of the photosensitive drum 31 after the first transfer.

The charging roll 32 is configured of a roll member having a conductive elastic layer and a conductive surface layer sequentially stacked on a conductive core bar made of aluminum, stainless steel or the like. The charging roll 32 is supplied with a charge bias voltage from a charge power source (not illustrated in the figure), and charges the surface of the photosensitive drum 31 while being driven to rotate by the photosensitive drum 31. Here, the value of the charge bias voltage supplied from the charge power source is set according to a control signal from the controller 60.

The developing unit 33 is configured as a developing unit 33Y, 33M, 33C or 33K that develops a toner of yellow (Y), magenta (M), cyan (C) or black (K) in each of the image forming units 30. Each of the developing units 33 holds, on a developing roll 34, a two-component developer composed of a color toner and magnetic carrier, and develops electrostatic latent images on the photosensitive drum 31 by applying a direct voltage or a developing bias voltage to the developing roll 34. Here, the developing bias voltage is obtained by superimposing a direct voltage on an alternating voltage.

The developing units 33 are configured to be connected via toner conveyance paths (not illustrated in the figure) to toner containers 35Y, 35M, 35C and 35K, respectively, that store toners of the respective colors, and to be refilled with the toner by refill screws (not illustrated in the figure) provided in the toner conveyance paths. In addition, the developing unit 33 is provided therein with a toner density sensor 69 that detects a blend ratio (toner density) between the toner and the magnetic carrier in the two-component developer by checking, for example, a change of the magnetic permeability of the two-component developer. The toner density sensor 69 detects the toner density of the two-component developer and transmits the detection value (toner density detection value) to the controller 60. The controller 60 controls an operation of the refill screw inside the toner conveyance path according to the obtained toner density detection value. With this control, the amounts of the respective color toners refilled from the toner containers 35Y, 35M, 35C and 35K to the respective developing units 33 are adjusted and thus the toner densities inside the developing units 33 are controlled.

Moreover, downstream of the charging roll 32 in the rotation direction of the photosensitive drum 31, the image forming unit 30 includes a potential sensor 68 that detects the surface potential on the photosensitive drum 31. The potential sensor 68 detects the surface potential of the photosensitive drum 31, and transmits the detection value (surface potential detection value) to the controller 60. The controller 60 controls the surface potential of the photosensitive drum 31 according to the obtained surface potential detection value.

In addition, the image-formation process unit 20 includes a laser-exposure unit 26, an intermediate transfer belt 41, first transfer rolls 42, a second transfer roll 40 and a fixing unit 80. The laser-exposure unit 26 exposes each of the photosensitive drums 31 provided with the respective image forming units 30. The intermediate transfer belt 41 receives a multi-transfer of toner images of the respective colors formed on the photosensitive drums 31 of the image forming units 30. The first transfer rolls 42 sequentially transfer the respective color toner images of the image forming units 30 to the intermediate transfer belt 41 at first transfer portions T1 (first-transfer). The second transfer roll 40 collectively transfers the superimposed toner images transferred on the intermediate transfer belt 41 to a paper sheet P that is a recording material (recording paper) at a second transfer portion T2 (second-transfer). The fixing unit 80 fixes the second-transferred image on the paper sheet P.

The laser-exposure unit 26 includes a semiconductor laser 27 as a light source, a scanning optical system (not illustrated in the figure) that scans and exposes the photosensitive drum 31 with laser light, a rotating polygon mirror (a polygon mirror) 28 formed, for example, in a regular hexahedron, and a laser driver 29 that controls the driving of the semiconductor laser 27. The laser driver 29 receives an input of image data from the image processing unit 22, and a light amount control signal and the like from the controller 60, and controls the lighting-up, the output light amount and the like of the semiconductor laser 27.

The first transfer rolls 42 and the second transfer roll 40 are each configured of a roll member having a conductive elastic layer and a conductive surface layer sequentially stacked on a conductive core bar made of aluminum, stainless steel or the like. The first transfer rolls 42 are each supplied with a first transfer bias voltage from a first transfer power source (not illustrated in the figure) and transfer the toner images onto the intermediate transfer belt 41. In addition, the second transfer roll 40 is supplied with a second transfer bias voltage from a second transfer power source (not illustrated in the figure), and transfers the toner image onto the paper sheet P. Here, the values of the first and second transfer bias voltages supplied from the first and second transfer power sources, respectively, are set according to control signals from the controller 60.

The fixing unit 80 includes a fixing roll 82 internally having a heat source, a pressing roll 83 that is arranged to press the fixing roll 82, and a temperature sensor 81 that detects the surface temperature of the fixing roll 82. The fixing unit 80 causes the paper sheet P having a not-fixed toner image thereon to pass between the fixing roll 82 and the pressing roll 83 while heating up and pressurizing the not-fixed toner image, and thereby fixes the toner image on the paper sheet P. At this time, the temperature sensor 81 detects the surface temperature of the fixing roll 82, and transmits the detection value (a surface temperature detection value) to the controller 60. According to the obtained surface temperature detection value, the controller 60 sets an output value from a fixing power source (not illustrated in the figure) that supplies a current to the heat source of the fixing roll 82, and thereby controls the surface temperature of the fixing roll 82. Moreover, the fixing unit 80 controls a speed of conveying the paper sheet P according to a control signal from the controller 60.

In the image forming apparatus 1 having the above-mentioned configuration according to the first exemplary embodiment, the image-formation process unit 20 performs image forming operations under control of the controller 60. To be more precise, the image data inputted from the PC 3, the image reading apparatus 4 or the like is subjected to certain image processing by the image processing unit 22, and then provided to the laser-exposure unit 26. Thereafter, for example, in the image forming unit 30Y of yellow (Y), the electrostatic latent image is formed on the photosensitive drum 31 in the following way. Firstly, the charging roll 32 uniformly charges the surface of the photosensitive drum 31 at the certain potential. Then, the laser-exposure unit 26 scans and exposes the charged surface of the photosensitive drum 31 with laser light whose lighting operation is controlled according to the image data from the image processing unit 22. The formed electrostatic latent image is developed by the developing unit 33Y, and thereby the yellow (Y) toner image is formed on the photosensitive drum 31. In the image forming units 30M, 30C and 30K, the respective color toner images of magenta (M), cyan (C) and black (K) are also formed in the same way.

The color toner images of the respective image forming units 30 are electrostatically transferred on the intermediate transfer belt 41 by the first transfer rolls 42, one by one, and thereby form the superimposed toner images on the intermediate transfer belt 41. At this time, the intermediate transfer belt 41 circularly moves in an arrow B direction in FIG. 1, and the certain first transfer bias voltage is applied to the first transfer roll 42 by the transfer power source (not illustrated in the figure). The superimposed toner images are conveyed with the movement of the intermediate transfer belt 41 toward the second transfer portion T2 where the second transfer roll 40 and a backup roll 49 are arranged. On the other hand, the paper sheets P are taken out from a paper holding unit 71 by a pickup roll 72 for a feeding operation, and conveyed one by one along a conveyance route R1 to the position of resist rolls 74 for adjusting a position of the paper sheet P.

When the superimposed toner images are conveyed to the second transfer portion T2, the paper sheet P is supplied to the second transfer portion T2 from the resist roll 74 at a timing when the toner images just arrive at the second transfer portion T2. Then, at the second transfer portion T2, the superimposed toner images are collectively and electrostatically transferred (second-transferred) on the paper sheet P by action of a transfer electric field formed between the backup roll 49 and the second transfer roll 40 to which the second transfer bias voltage is applied.

Incidentally, the paper sheet P is also conveyed to the second transfer portion T2 via a conveyance route R2 for both side printing or a conveyance route R3 from a paper holding unit 75 for manual paper feeding.

After that, the paper sheet P having superimposed toner images electrostatically transferred thereon is separated from the intermediate transfer belt 41 and conveyed to the fixing unit 80. The not-fixed toner image on the paper sheet P conveyed to the fixing unit 80 is subjected to fixing processing with a heat and a pressure by the fixing unit 80, and thereby being fixed on the paper sheet P. Then, the paper sheet P having the fixed image formed thereon is conveyed to a paper stack unit 91 provided at an exit portion of the image forming apparatus 1. Meanwhile, the toner attached to the intermediate transfer belt 41 after the second-transfer (transfer residual toner) is removed by a belt cleaner 45 that is in contact with the intermediate transfer belt 41, and is made ready for the next image forming cycle.

In this way, the image formation in the image forming apparatus 1 is repeatedly executed for a designated number of paper sheets.

Here, the image forming apparatus 1 according to the first exemplary embodiment is configured to select one of multiple image forming modes according to a kind of paper sheet P, a required resolution and the like. The multiple image forming modes allow different process speeds PS to be set. For example, a first process speed PS1 (for example, 104 mm/sec) is set in a "plain-paper mode" using plain paper (for example, a basis weight of 64 g/m$^2$) as the paper sheet P, and a second process speed PS2 (for example, 52 mm/sec) is set in a "thick-paper mode" using thick paper (for example, a basis weight of 108 g/m$^2$) or an OHP sheet as the paper sheet P. This switching (change) between the process speeds PS is carried out by the controller 60 that also functions as a speed changing unit and a speed information obtaining unit in the first exemplary embodiment.

Moreover, the image forming apparatus 1 of the first exemplary embodiment performs "setup processing" at a start time and an end time of image formation, and at certain intervals, such as every certain number of printed sheets, during image forming operations. The setup processing here is performed to obtain the high quality of images formed by the image forming apparatus 1 constantly. More precisely, in the setup processing, a setting value of each image forming factor (also referred to as an "image forming condition" below) is appropriately changed by using a state quantity indicating the state of an image formed by each of the image forming units 30, thereby adjusting the densities (image densities) and tones of the image. Usable setting values of the image forming factors determining image quality are the value of the output light amount of the semiconductor laser 27 in the laser-exposure unit 26, the value of the charge bias voltage supplied to the charging roll 32 and the like. This setup processing is performed under control of the controller 60 that also functions as an adjusting unit in the first exemplary embodiment.

An example of the setup processing performed by the image forming apparatus 1 of the first exemplary embodiment will be described.

Firstly, the controller 60 sets the surface potential of the photosensitive drum 31 in each of the image forming units 30 at predetermined two levels, that is, a high potential level and a low potential level, sequentially. At this time, each of various image forming conditions such as the output light amount value of the semiconductor laser 27, the developing bias voltage value, and the first transfer bias voltage value for the first transfer roll 42 is set to a predetermined certain value. Then, the image forming units 30 each generates multiple reference density patterns having different area ratios (tones) at each of the potential levels.

Figure 3:
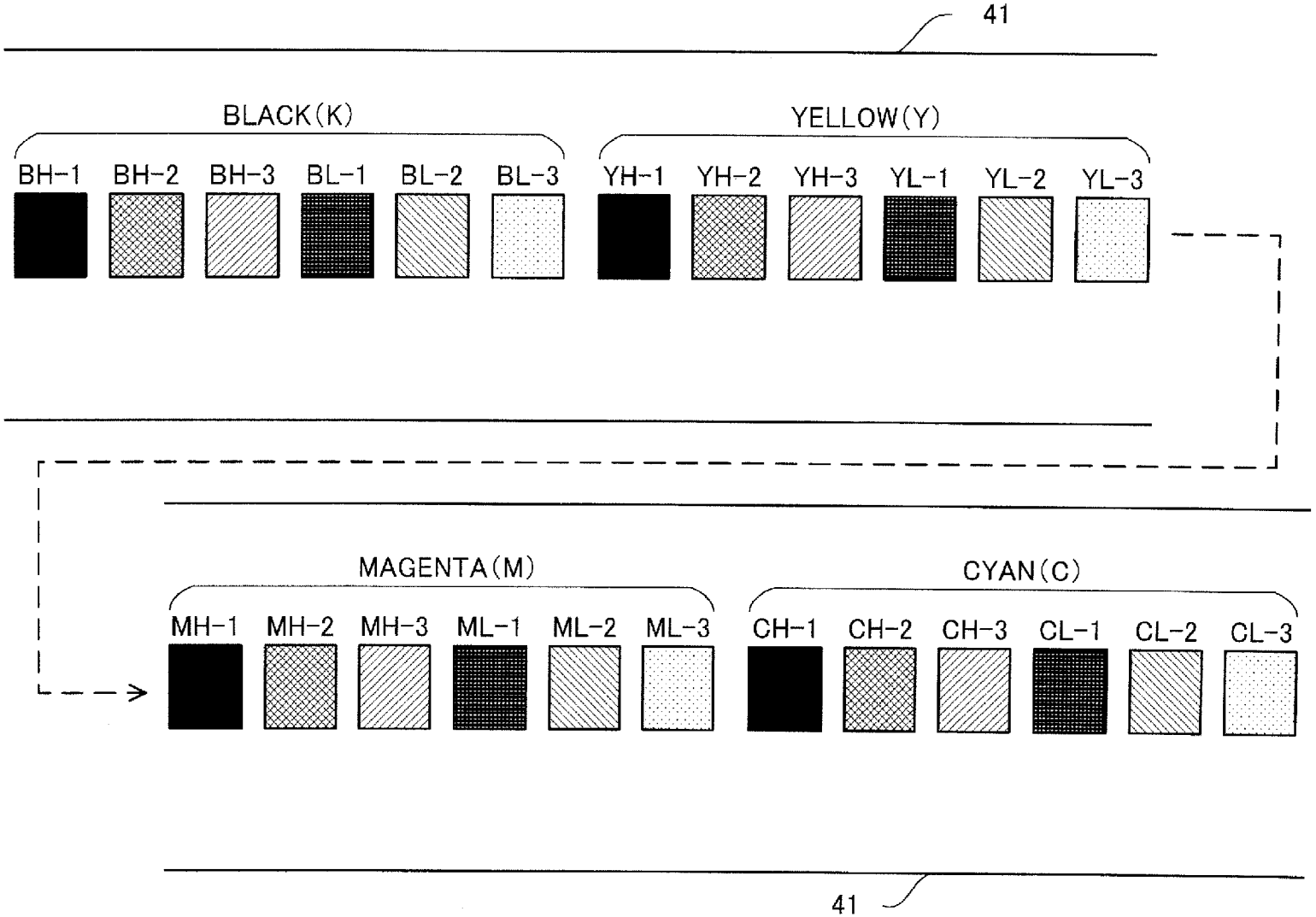
FIG. 3 is a diagram showing the multiple reference density patterns of different tones generated by each of the image forming units and first-transferred on the intermediate transfer belt.

Here, FIG. 3 is a diagram showing the multiple reference density patterns of different tones generated by each of the image forming units 30 and first-transferred on the intermediate transfer belt 41. The example shown in FIG. 3 shows the case where the image forming unit 30K of black (K), for example, forms three reference density patterns BH-1, BH-2 and BH-3 of three tones at the high potential level and three reference density patterns BL-1, BL-2 and BL-3 of three tones at the low potential level. Accordingly, the image forming unit 30K forms the six reference density patterns of six tones in total. Likewise, the image forming unit 30Y of yellow (Y) forms reference density patterns YH-1, YH-2 and YH-3 as well as YL-1, YL-2 and YL-3, the image forming unit 30M of magenta (M) forms reference density patterns MH-1, MH-2 and MH-3 as well as ML-1, ML-2 and ML-3, and the image forming unit 30C of cyan (C) form reference density patterns CH-1, CH-2 and CH-3 as well as CL-1, CL-2 and CL-3.

The densities of the respective reference density patterns for each color formed as the example shown in FIG. 3 are detected by the reference density detection sensor 55 arranged downstream of the image forming unit 30K in the moving direction of the intermediate transfer belt 41. Then, the detected density values of the reference density patterns for each color are transmitted to the controller 60 as the state quantities each indicating the state of an image formed by each of the image forming units 30. Similarly, the detection value of the internal humidity (detected humidity value) detected by the humidity sensor 56 and the detection value of the internal temperature (detected temperature value) detected by the temperature sensor 57 are also transmitted to the controller 60.

Then, the controller 60 sets the various image forming conditions according to the detected density values of the reference density patterns for each color, the detected humidity value and the detected temperature value, and thereby adjusts the image densities and tones so that the high image quality would be maintained.

Figure 4:
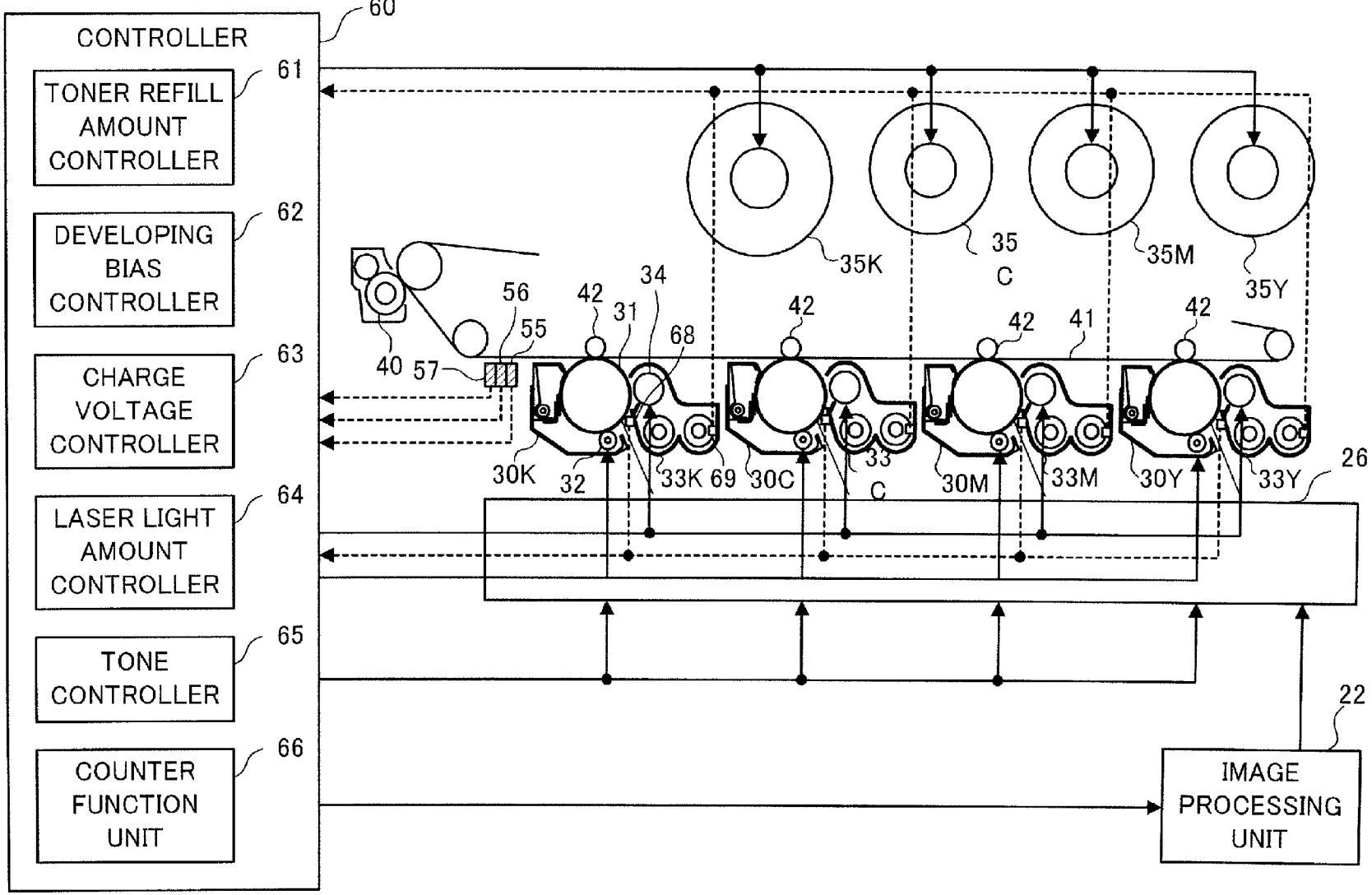
FIG. 4 is a block diagram explaining a functional configuration that performs the setup processing in the controller in the first exemplary embodiment.

Next, FIG. 4 is a block diagram explaining a functional configuration that performs the setup processing in the controller 60 in the first exemplary embodiment. As shown in FIG. 4, the controller 60 includes, as functional units that perform the setup processing, a toner refill amount controller 61, a developing bias controller 62, a charge voltage controller 63, a laser light amount controller 64, a tone controller 65 and a counter function unit 66 as an example of a measuring unit. The detected density values of the reference density patterns for each color of the reference density detection sensor 55, the detected humidity value of the humidity sensor 56, the detected temperature value of the temperature sensor 57 and the like are transmitted to the toner refill amount controller 61, the developing bias controller 62, the charge voltage controller 63, the laser light amount controller 64 and the tone controller 65.

Figure 5:
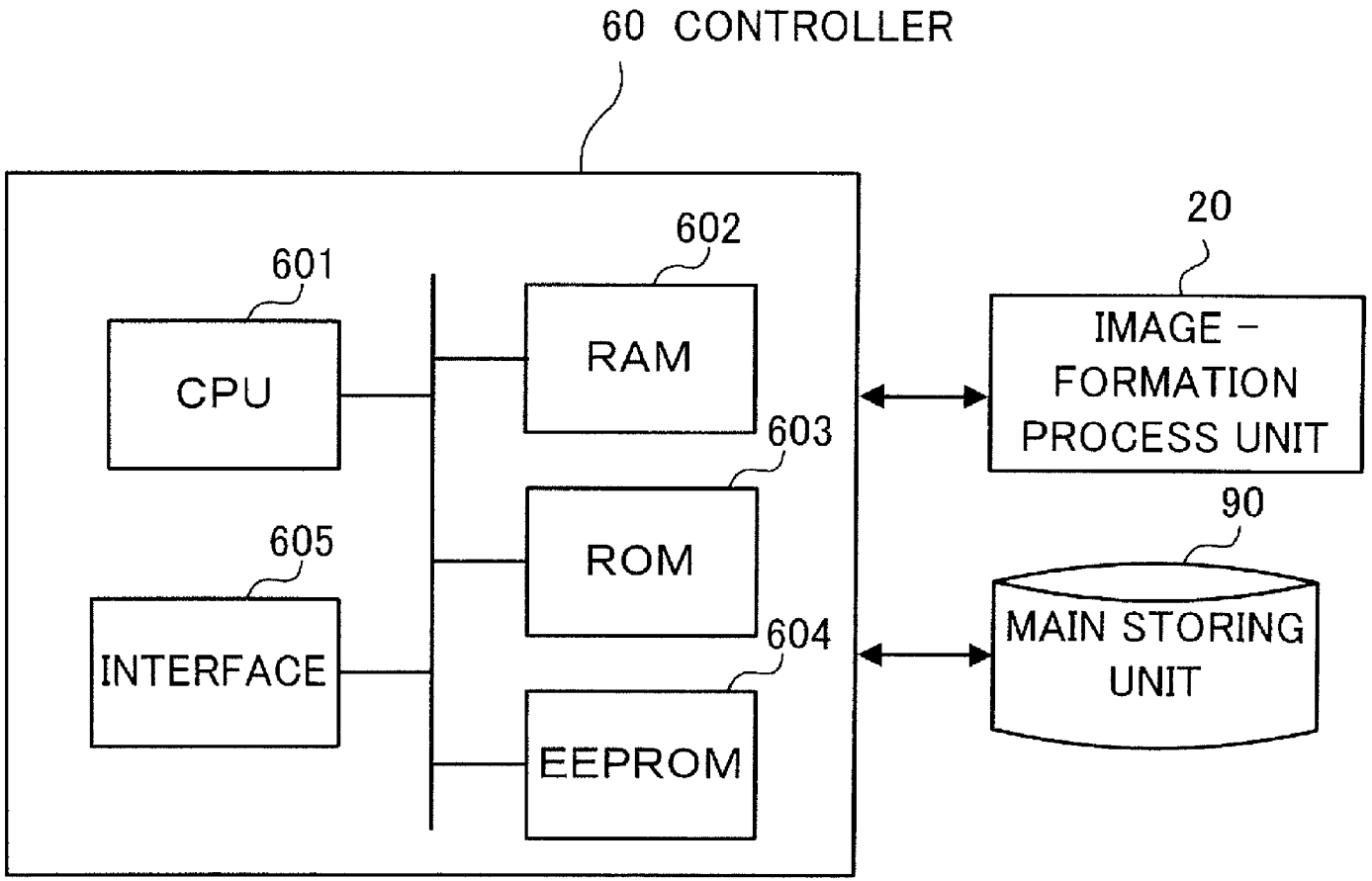
FIG. 5 is a block diagram showing an internal configuration of the controller of the first exemplary embodiment.

In addition, FIG. 5 is a block diagram showing an internal configuration of the controller 60 of the first exemplary embodiment. As shown in FIG. 5, the controller 60 includes a CPU (central processing unit) 601, a RAM (random access memory) 602, a ROM (read-only memory) 603, an EEPROM (electronically erasable and programmable read only memory) 604 and an interface 605. The CPU 601 executes digital arithmetic processing in accordance with a predetermined processing program when performing the setup processing. The RAM 602 is used as a storing unit or the like for the operation of the CPU 601. In the ROM 603, the processing program and the like to be executed by the CPU 601 are stored. The EEPROM 604 is an example of a memory that is rewritable and capable of holding data even when the power supply is stopped. The interface 605 controls input and output of signals to and from each unit connected to the controller 60, such as the image-formation process unit 20, the main storing unit 90 and the reference density detection sensor 55.

The CPU 601 of the controller 60 performs various kinds of processing by reading, from the main storing unit 90 to the RAM 602 or the like, a program for implementing the functions of the toner refill amount controller 61, the developing bias controller 62, the charge voltage controller 63, the laser light amount controller 64, the tone controller 65 and the counter function unit 66. In addition, a table (for example, a charge bias voltage table) provided to each functional unit, to be described later, is prestored in the EEPROM 604 of the controller 60.

In addition, the processing program to be executed by the controller 60 is stored in the main storing unit 90. Hence, the controller 60 reads the processing program at a start-up time of the image forming apparatus 1, and thereby the controller 60 of the first exemplary embodiment executes the setup processing.

The laser light amount controller 64 is provided with an output light amount table determining correspondences of the output light amount with each of the detected density values (or a difference between the detected density value and its target value), the detected humidity value and the detected temperature value. According to this output light amount table, the laser light amount controller 64 controls the value of the output light amount of the semiconductor laser 27 that emits from the laser-exposure unit 26 to the photosensitive drum 31. The charge voltage controller 63 is provided with a charge bias voltage table determining correspondences of the charge bias voltage value with the each of the detected density values (or the difference between the detected density value and its target value), the detected humidity value and the detected temperature value. According to this charge bias voltage table, the charge voltage controller 63 controls the value of the charge bias voltage supplied to each of the charging rolls 32 of the respective image forming units 30. The developing bias controller 62 is provided with a developing bias voltage table determining correspondences of the developing bias voltage value with each of the detected density values (or the difference between the detected density value and its target value), the detected humidity value and the detected temperature value. According to this developing bias voltage table, the developing bias controller 62 controls the value of the developing bias voltage applied to the developing roll 34. The toner refill amount controller 61 is provided with a toner density table determining correspondences of the toner density with each of the detected density values (or the difference between the detected density value and its target value), the detected humidity value and the detected temperature value. According to this toner density table, the toner refill amount controller 61 controls, if needed, the toner refill amounts of the respective colors refilled in the respective developing units 33 by the toner containers 35Y, 35M, 35C and 35K.

Moreover, the tone controller 65 generates tone control signals based on the detected density values of the reference density detection sensor 55, and outputs the tone control signals to the image processing unit 22. The image processing unit 22 is provided with a lookup table (LUT) for transforming the area ratios of inputted image data according to the tone control signals. Thus, the image processing unit 22 changes the area ratios of the inputted image data by referring to the LUT according to the tone control signals, and transmits the resultant image data to the laser-exposure unit 26.

The counter function unit 66 has a function as a counter for measuring the number of printed sheets, for example. Specifically, the counter function unit 66 includes individual sheet-number counters CNT1 and CNT2. The sheet-number counter CNT1 measures the cumulative number of printed sheets after the last setup processing when the first process speed PS1 is set in the plain-paper mode. On the other hand, the sheet-number counter CNT2 measures the cumulative number of printed sheets after the last setup processing when the second process speed PS2 is set in the thick-paper mode.

It should be noted that the controller 60 of the first exemplary embodiment is configured to control, as the image forming conditions, the value of the output light amount of the semiconductor laser 27 in the laser-exposure unit 26, the value of the charge bias voltage supplied to the charging roll 32 and the value of the developing bias voltage applied to the developing roll 34, and also, if necessary, the toner refill amounts of colors refilled in the respective developing units 33, when performing the setup processing. Further, the controller 60 may also be configured to control the surface temperature and the fixing speed of the fixing roll 82 in the fixing unit 80, and the value of the first transfer bias voltage applied to the first transfer roll 42 in addition to the aforementioned values, and to change the lookup table (LUT) that is provided to the image processing unit 22 and used corresponding to the tone control signals.

Hereinafter, descriptions will be provided for the setup processing performed by the controller 60 when the process speed PS is changed.

The image forming apparatus 1 of the first exemplary embodiment has a function with which, when the process speed PS is changed, the setup processing for the process speed PS after the change is performed by using, as a target value for an image density, each of the detected density values of the reference density patterns for each color which are detected for the first time after the process speed PS is changed.

Figure 6:
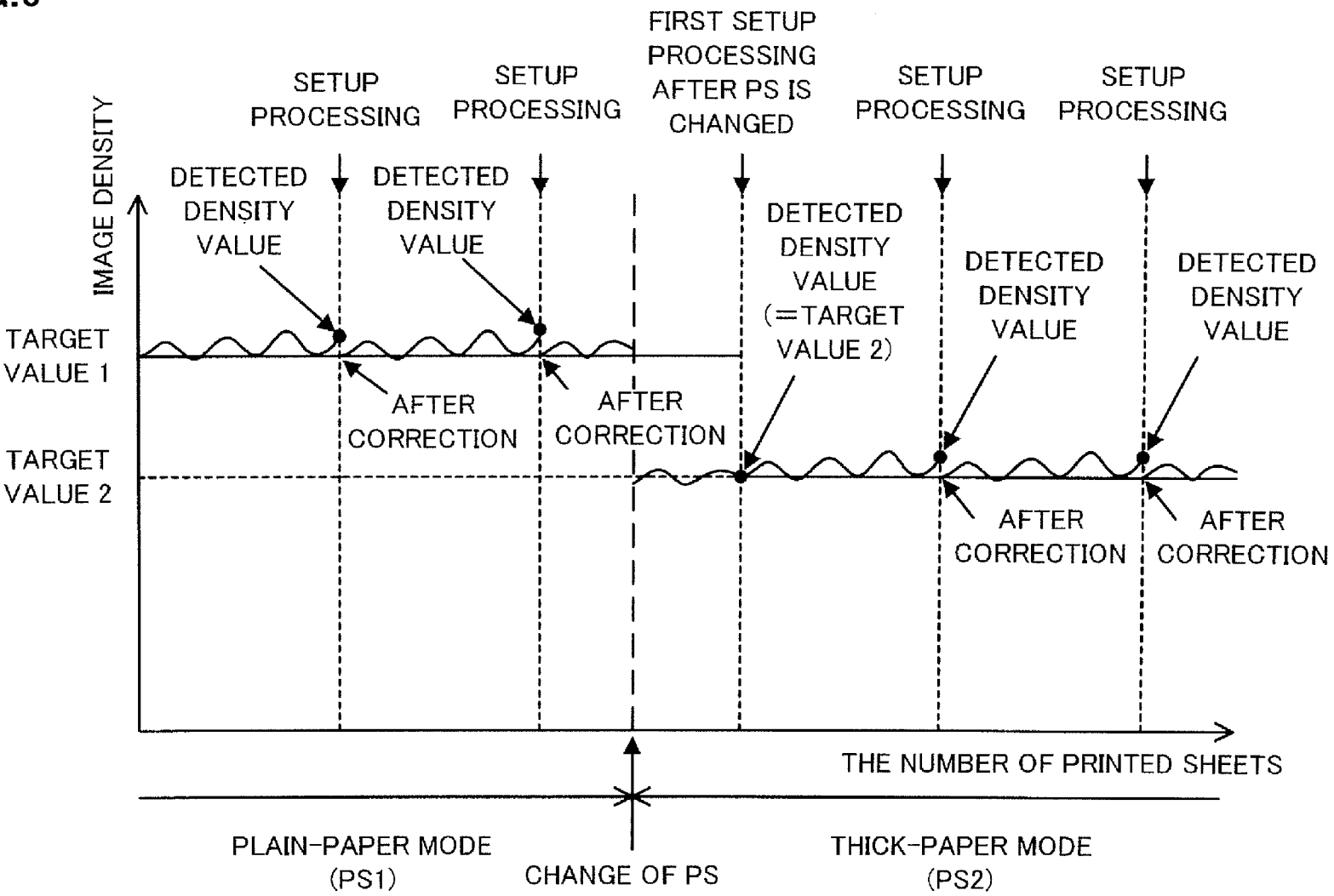
FIG. 6 is a diagram explaining the target value of the image density set in the setup processing after the process speed PS is changed.

FIG. 6 is a diagram explaining the target value of the image density set in the setup processing after the process speed PS is changed. The example in FIG. 6 shows the case where the first process speed PS1 initially set by setting the plain-paper mode is changed to the second process speed PS2 by setting the thick-paper mode. In addition, the setup processing is performed, provided that certain number of printed sheets that is set for each process speed PS is reached after performing the last setup processing, which will be described later.

As shown in FIG. 6, in the plain-paper mode of the first process speed PS1 that is set initially, the following setup processing is performed. Specifically, the target value 1 for each of the image densities in the plain-paper mode is previously set in the controller 60, and the controller 60 compares the target value 1 with the detected density value of each color reference density pattern that is detected by the reference density detection sensor 55. The controller 60 previously stores the target values 1 in the EEPROM 604 inside the controller 60. Then, according to the result of comparison of the detected density value with the target value 1 stored in the EEPROM 604 in terms of the image density, and also according to the detected humidity value and the detected temperature value, the controller 60 controls the output light amount value of the semiconductor laser 27, the charge bias voltage value and the developing bias voltage value so that the image density would be the target value 1. With regard to subsequent setup processing in the plain-paper mode, it is similar to the setup processing mentioned above.

It should be noted that the target value 1 here for the image density is an example of the target value of the state quantity.

Then, the thick-paper mode is set and thereby the process speed PS is changed. In this case, the following setup processing is performed in the first setup processing after the process speed PS is changed to the second process speed PS2. Specifically, the controller 60 sets, as a target value for each of the image densities (target value 2), the detected density value of a corresponding one of the color reference density patterns in the first setup processing. The controller 60 stores the target value 2 in the EEPROM 604 inside the controller 60 when this first setup processing is performed. Subsequently, the output light amount value of the semiconductor laser 27, the charge bias voltage value and the developing bias voltage value are set when the image density is set to the target value 2. Thereafter, in the subsequent setup processing in the thick-paper mode, the controller 60 compares the target value 2 stored in the EEPROM 604 with the detected density value of each color reference density pattern that is detected by the reference density detection sensor 55.

Then, according to the result of comparison of the detected density value with the target value 2 in terms of the image density, and also according to the detected humidity value and the detected temperature value, the output light amount value of the semiconductor laser 27, the charge bias voltage value and the developing bias voltage value are controlled so that the image density would be the target value 2.

It should be noted that the target value 2 here for the image density is an example of the target value of the state quantity.

Here, when the process speed PS is changed as a result of a change of the image forming mode setting, the detected density value of each color reference density pattern in the first setup processing at the newly-set process speed PS is set as the target value for the image density at the newly-set process speed PS.

In this way, in the image forming apparatus 1 of the first exemplary embodiment, since the process speed PS is changed between different paper sheets P, the image density varies before and after a change of the process speed PS, but a variation in the image density in the same image forming mode is reduced. Thus, the image forming apparatus 1 of the first exemplary embodiment performs the setup processing for making the variation in the image density in the same image forming mode set small.

In other words, as described later, the image forming apparatus 1 of the first exemplary embodiment performs the setup processing after the process speed PS is changed, provided that the interval setting the timing of performing the last setup processing for each process speed PS as a reference point exceeds a predetermined interval set as, for example, a certain number of printed sheets for each process speed PS. Thereby, productivity in image forming processing is prevented from decreasing largely.

Subsequently, descriptions will be provided for processing of determining whether or not the setup processing is performed when the process speed PS is changed.

In a case where the process speed PS is changed to a certain process speed PS, the controller 60 of the first exemplary embodiment determines whether or not the setup processing is performed according to whether or not the number of printed sheets as an example of an image forming period reaches the certain number after the last setup processing performed at the certain processing speed PS. Then, the controller 60 makes control such that the setup processing may be performed when the number of printed sheets reaches the certain number, and that the setup processing may not be performed when the number of printed sheets does not reach the certain number.

Here, as similar to the above description, assume that the first process speed PS1 is set as an example of a first image forming speed when the plain-paper mode is selected, and that the second process speed PS2 is set as an example of a second image forming speed when the thick-paper mode is selected. The controller 60 includes individual sheet-number counters CNT1 and CNT2 in the counter function unit 66. The sheet-number counter CNT1 is an example of a measuring unit that measures the cumulative number of printed sheets which is an example of a state representing a period elapsed after the last setup processing performed under the condition that the first process speed PS1 is set. The sheet-number counter CNT2 is an example of a measuring unit that measures the cumulative number of printed sheets which is an example of a state representing a period elapsed after the last setup processing performed under the condition that the second process speed PS2 is set. Moreover, the descriptions will be provided by taking the output light amount of the semiconductor laser 27 as an example of image forming conditions whose setting is to be changed. However, the settings of the other image forming conditions such as the charge bias voltage value and the developing bias voltage value are also changed similarly as needed.

At first, a description will be given to an overall flow of the processing in which the controller determines whether or not to perform the setup processing.

Figure 7:
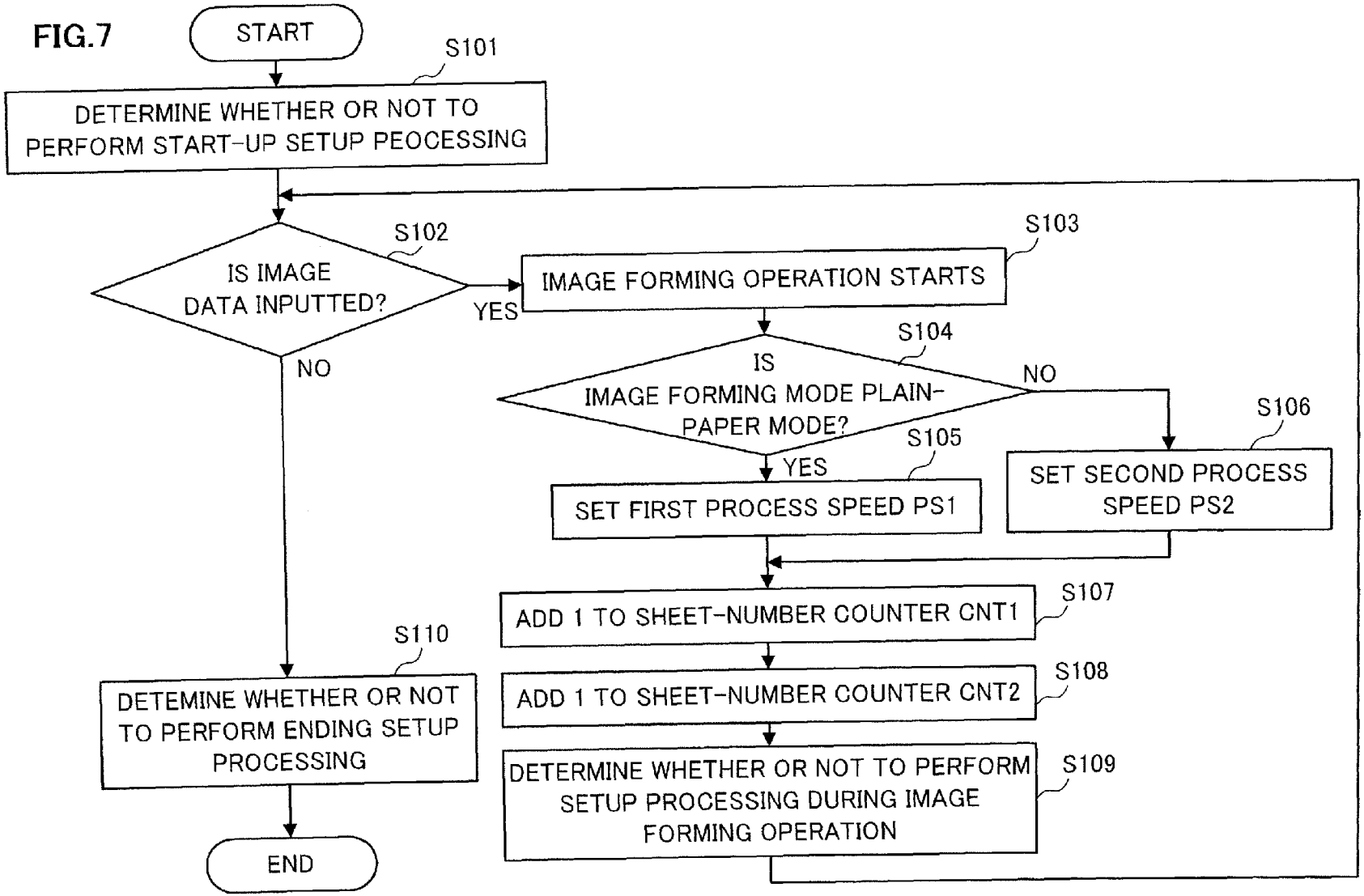
FIG. 7 is a flowchart showing the overall flow of the processing in which the controller determines whether or not to perform the setup processing.

FIG. 7 is a flowchart showing the overall flow of the processing in which the controller 60 determines whether or not to perform the setup processing. As shown in FIG. 7, until the time when the image forming operation is started after a main switch of the image forming apparatus 1 is turned on, the controller 60 determines whether or not to perform setup processing (start-up setup processing) for starting up the image forming apparatus 1 (S101). It should be noted that the start-up setup processing will be described later by using subsequent FIG. 8.

Next, when image data to be printed is inputted (S102), the image forming operation starts (S103). Then, the controller 60 determines the set image forming mode (S104). As mentioned above, the controller 60 of the first exemplary embodiment functions as a speed changing unit. When the controller 60 determines that the plain-paper mode is set in step 104, the controller 60 sets the first process speed PS1 (S105). Instead, when the controller 60 determines that the thick-paper mode is set in step 104, the controller 60 sets the second process speed PS2 (S106).

When the first process speed PS1 is set (S105), the controller 60 adds one (1) to the count value of the sheet-number counter CNT1 on every cycle of the image forming operation (S107). In addition, at the same time, the controller 60 adds 1 to the count value of the sheet-number counter CNT2 on every cycle of the image forming operation (S108). Thereafter, the controller 60 determines whether or not to perform the setup processing during the image forming operation of the image forming apparatus 1. Instead, when the second process speed PS2 is set (S106), the controller 60 adds 1 to the count value of the sheet-number counter CNT1 on every cycle of the image forming operation (S107). In addition, at the same time, the controller 60 adds 1 to the count value of the sheet-number counter CNT2 on every cycle of the image forming operation (S108). Thereafter, the controller 60 determines whether or not to perform the setup processing during the image forming operation of the image forming apparatus 1 (S109). The controller 60 repeats the determination processing until the image data input ends. It should be noted that the setup processing during the image forming operation will be described by using subsequent FIG. 10.

Then, when the input of the image data to be printed ends (S102), the controller 60 determines whether or not to perform setup processing at a time of ending the image forming operation of the image forming apparatus 1 (ending setup processing) (S110). It should be noted that the ending setup processing will be described later by using subsequent FIG. 10.

Figure 8A:
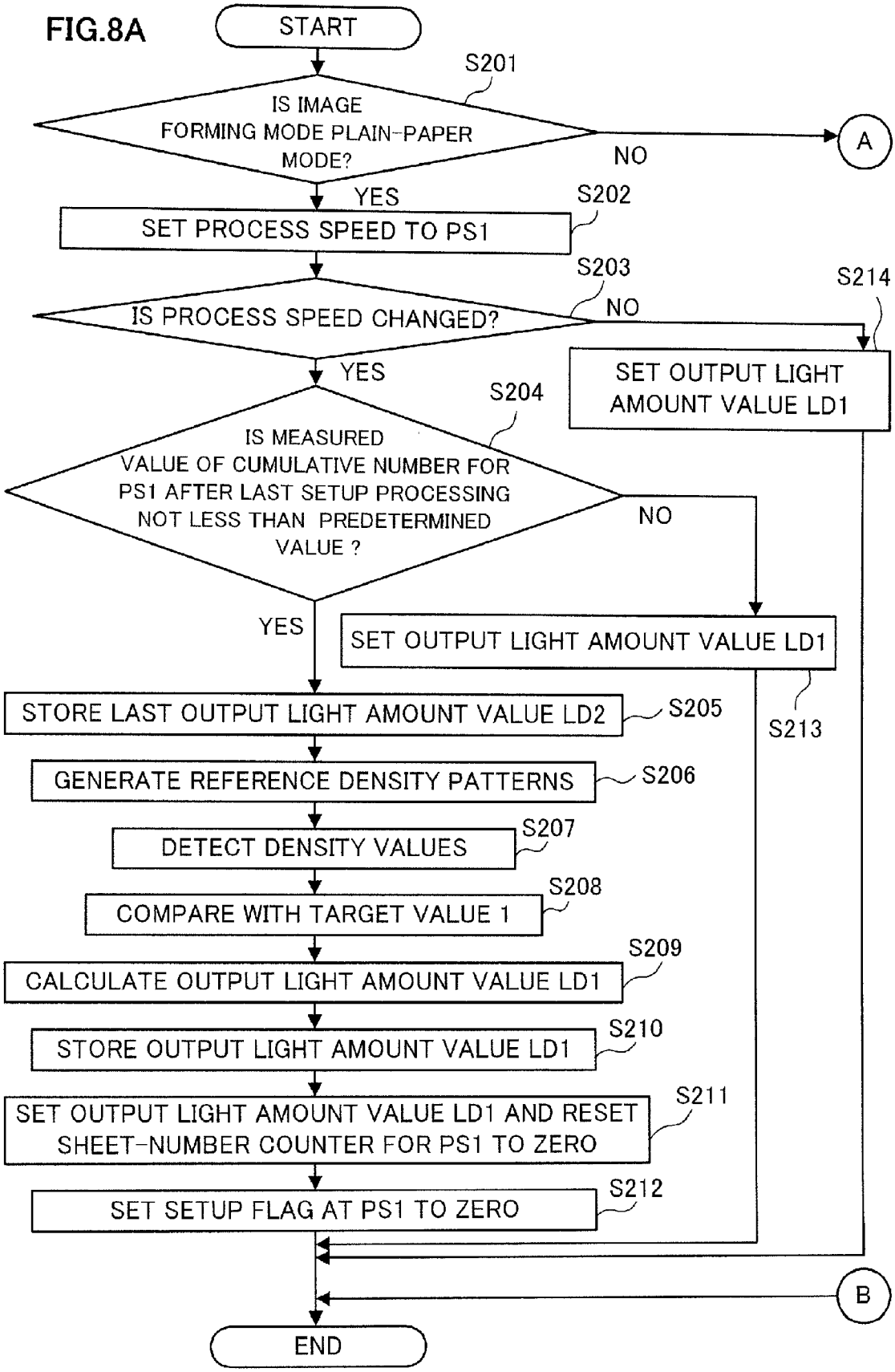
FIG. 8 consisting of 8A and 8B is a flowchart showing an example of the procedure in which the controller determines whether or not the start-up setup processing is performed.
Figure 8B:
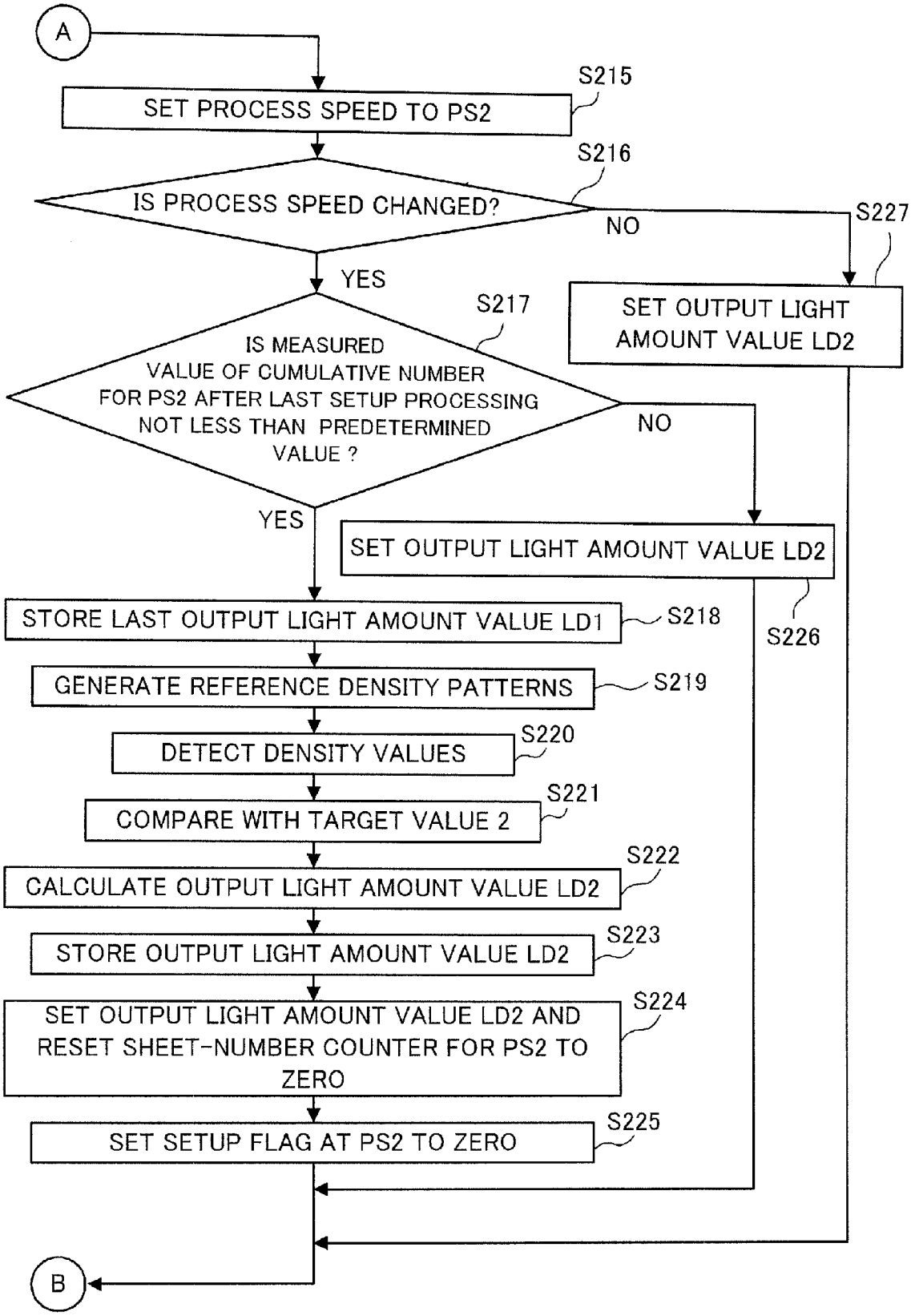

Subsequently, FIG. 8 is a flowchart showing an example of the procedure in which the controller 60 determines whether or not the start-up setup processing is performed. As shown in FIG. 8, in determination processing of the start-up setup processing, the controller 60 determines the set image forming mode (S201). When the controller 60 determines that the plain-paper mode is set in step 201, the controller 60 sets the first process speed PS1 (S202). Then, the controller 60 determines whether or not the process speed PS has been changed since the last image formation (S203).

When the controller determines in step 203 that the first process speed PS1 is set as a result of the change of the process speed PS, the controller 60 determines whether or not the measured value of the cumulative number of printed sheets for the first process speed PS1 after the last setup processing, is not less than a predetermined value (S204). In other words, the controller 60 determines whether or not the measured value of the cumulative number of printed sheets in each of the first process speed PS1 and the second process speed PS2 reaches the predetermined value after the last setup processing is performed at the first process speed PS1. When the measured value of the cumulative number of printed sheets reaches the predetermined value, the controller 60 starts the setup processing. Here, since the image density is likely to vary largely in comparison with the case where the image formation is performed in the same process speed, which is caused by the change of the image forming condition according to the change of the process speed, "the predetermined value" in step 204 may be set to be shorter than the number of printed sheet (the interval) set in the setup processing during the image forming operation at the first process speed PS1 and the ending setup processing.

In addition, when it has been a long time since the last image formation, the image density is likely to vary largely. For this reason, when the process speed is changed, "the predetermined value" may be set to be shorter than that generally set in step 204 according to elapsed time from the last setup processing at the process speed after the process speed is changed or elapsed time from the last image formation at the process speed before the process speed is changed.

When the setup processing is started, the controller 60 firstly stores, in the EEPROM 604, the output light amount value LD2 of the semiconductor laser 27 at the second process speed PS2 that is set in the last image formation (S205). Subsequently, the controller 60 generates the reference density patterns (see FIG. 3) (S206), and the density values thereof are detected for each color by the reference density detection sensor 55 (S207). Then, the controller 60 compares the detected density values of the reference density patterns for each color with the target values (the target values 1) for the image densities at the first process speed PS1 stored in the EEPROM 604 (S208).

By using the output light amount table determining the correspondences of the output light amount with the detected humidity value, the detected temperature value and the difference between each of the detected density values and the target values 1, the controller 60 calculates the output light amount value LD1 of the semiconductor laser 27 for irradiating the photosensitive drum 31 from the laser-exposure unit 26 (S209). Then, the calculated output light amount value LD1 is stored in the EEPROM 604 (S210). Moreover, the output light amount of the semiconductor laser 27 is set to the calculated output light amount value LD1, and the sheet-number counter CNT1 for the first process speed PS1 is reset to "0" (S211).

In addition, the controller 60 sets a setup flag to "0" (S212). The setup flag here is data indicating whether or not the second or subsequent setup processing is performed at the process speed PS1 while the set up processing at PS2 is not performed after the process speed PS1 is changed. More specifically, the setup flag is set to "1" when the second or subsequent setup processing is performed at the process speed PS1 while the setup processing is not performed at the process speed PS2, and the setup flag is set to "0" when the second or subsequent setup processing is not performed. Upon completion of the start-up setup processing, the image forming operation starts immediately. Thereafter, the determination processing for the setup processing during image forming operation is performed. Accordingly, upon completion of the start-up setup processing, the setup flag is always set to "0." It should be noted that this setup flag is used in a case where the measured value of the cumulative number of printed sheets is determined not to reach the predetermined value in step 204 or step 217 even though the process speed PS is changed and the processing of setting the state quantity without being accompanied by the setup processing is performed, as will be described later.

As described above, in the image forming apparatus 1 of the first exemplary embodiment, when the image forming apparatus 1 is started up, and if the number of printed sheets after the last setup processing performed at the first process speed PS1 reaches the predetermined value, the setup processing is newly performed to set the various image forming conditions.

On the other hand, when, from the measured value of the sheet-number counter CNT1 for the first process speed PS1, the measured value of the cumulative number of printed sheets after the last setup processing performed is determined not to reach the predetermined value, the setup processing is not performed. In this case, the following processing of setting the output light amount of the semiconductor laser 27 is performed (S213).

Figure 9A:
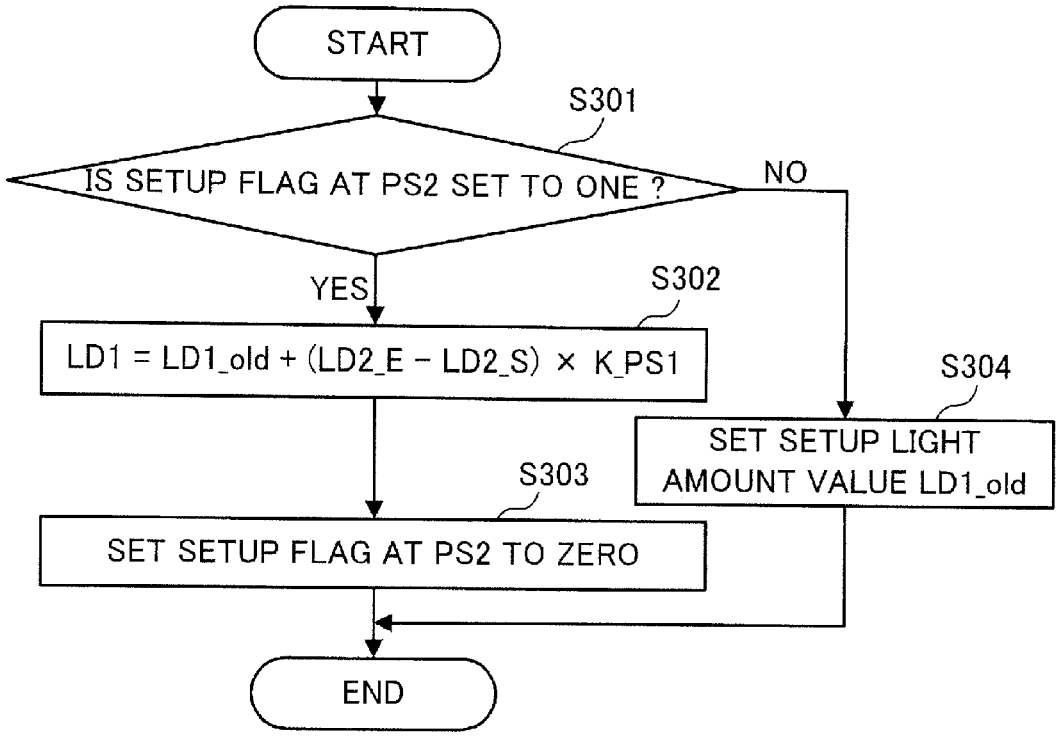
FIGS. 9A and 9B are diagrams for explaining an example of the processing of setting the output light amount of the semiconductor laser.
Figure 9B:
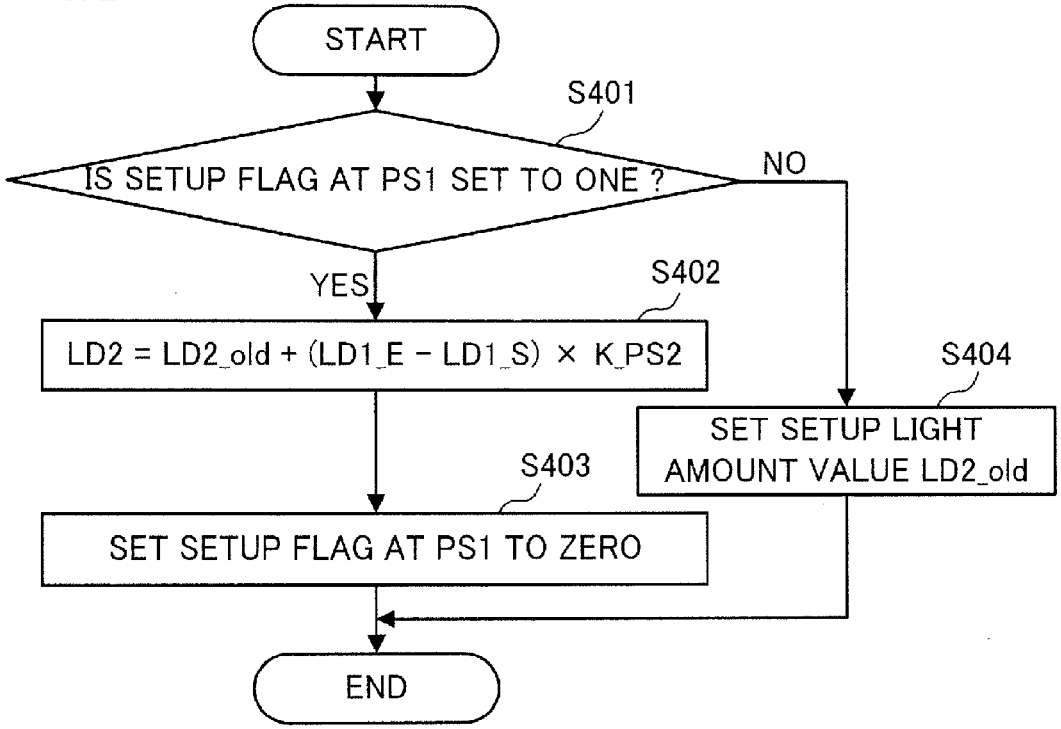

FIGS. 9A and 9B are diagrams for explaining an example of the processing of setting the output light amount of the semiconductor laser 27. FIG. 9A is a flowchart showing the processing of setting the output light amount LD1 for the first process speed PS2 in step 213, and FIG. 9B is a flowchart showing the processing of setting the output light amount LD2 for the second process speed PS1 in step 226.

As shown in FIG. 9A, in the setting processing in step 213, the output light amount LD1 is set according to the output light amount set before the start-up setup processing performed, that is, the output light amount set in the last image forming operation. Here, the controller 60 firstly determines whether or not the setup flag is set to "1" (S301). More precisely, the controller 60 determines whether or not the second or subsequent setup processing with the process speed PS remaining unchanged after the change of the process speed PS is performed in the last setup processing during image forming operation or the ending setup processing.

Then, if the setup flag is determined to be "1" in step 301, the output light amount LD1 of the semiconductor laser 27 is read out from the EEPROM 604 inside the controller 60. The read-out output light amount LD1 is the output light amount at the first process speed PS1 lastly set in the last setup processing during image forming operation, and is defined as an output light amount LD1_old. Incidentally, as shown in step 210 in FIG. 8, the controller 60 of the first exemplary embodiment is configured to store, in the EEPROM 604 inside the controller 60, the output light amount LD1 set in the setup processing.

Next, when the first process speed PS1 lastly set is changed to the second process speed PS2 in the last image forming operation, the output light amounts LD2_S and LD2_E are read out from the EEPROM 604 inside the controller 60. Here, the output light amounts LD2_S and LD2_E are the first-set output light amount and the last-set output light amount, respectively, in the setup processing at the second process speed PS2. The calculation processing with the following equation (1) is performed by use of the read-out output light amounts LD2_S and LD2_E. Then, the output light amount LD1 obtained with the equation (1) is set as the output light amount LD1 of the semiconductor laser 27 in step 213 (S302). Specifically, $$LD1=LD1_old+K_PS1\cdot(LD2_E-LD2_S) \quad (1),$$

where K_PS1 denotes a correction coefficient.

Incidentally, an output light amount LD1_old' that is set before the last setup processing at the first process speed PS1 and stored in the EEPROM 604 may be used as the output light amount LD1_old.

Thereafter, the setup flag is set to "0" (S303).

On the other hand, when the setup flag is determined to be "0" in step 301, the output light amount LD1 is set to LD1_old (S304).

In setting processing in step 226 mentioned later, the processing is performed as similar to that in the setting processing in step 213. Specifically, as shown in FIG. 9B, the controller 60 firstly determines whether or not the setup flag is set to "1" (S401).

Then, if the setup flag is determined to be "1" in step 401, the output light amount LD2 of the semiconductor laser 27 is read out from the EEPROM 604 inside the controller 60. The read-out output light amount LD2 is the output light amount at the second process speed PS2 lastly set in the last setup processing during image forming operation, and is defined as an output light amount LD2_old. Incidentally, as shown in step 223 in FIG. 8, the controller 60 of the first exemplary embodiment is configured to store, in the EEPROM 604 inside the controller 60, the output light amount LD2 set in the setup processing.

Next, when the second process speed PS2 lastly set is changed to the first process speed PS1 in the last image forming operation, the output light amounts LD1_S and LD1_E are read out from the EEPROM 604 inside the controller 60. Here, the output light amounts LD1_S and LD1_E are the first-set output light amount and the last-set output light amount, respectively, in the setup processing at the first process speed PS1. The calculation processing with the following equation (2) is performed by use of the read-out output light amounts LD1_S and LD1_E. Then, the output light amount LD2 obtained with the equation (2) is set as the output light amount LD2 of the semiconductor laser 27 in step 226 (S402). Specifically, $$LD2=LD2_old+K_PS2\cdot(LD1_E-LD1_S) \quad (2),$$

where K_PS2 denotes a correction coefficient.

Incidentally, an output light amount LD2_old' that is set before the last setup processing at the second process speed PS2 and stored in the EEPROM 604 may be used as the output light amount LD2_old.

Thereafter, the setup flag is set to "0" (S403).

On the other hand, when the setup flag is determined to be "0" in step 401, the output light amount LD2 is set to LD2_old (S404).

As described above, in the case where the image forming apparatus 1 is started up, and if the setup processing is not performed even though the process speed PS is changed, the controller 60 of the first exemplary embodiment sets the state quantity (the output light amount LD of the semiconductor laser 27) in consideration of a variation in the light amount at the time of the change of the process speed PS. Thereby, the output light amount LD of the semiconductor laser 27 that leads to a small amount of variation in the image density is set in such a simple manner. In addition, the output light amount LD of the semiconductor laser 27 is set quickly, and accordingly the productivity of image formation is improved.

Here, return to the flowchart in FIG. 8. When the controller 60 determines in step 203 that the process speed PS has not been changed since the last image formation, the controller 60 sets, as the output light amount of the semiconductor laser 27, the output light amount value LD1 stored in the EEPROM 604 during the last setup processing without any modification (S214). In this case, similarly, the image density is not likely to vary largely. Accordingly, the productivity of the image formation is improved by using the output light amount value LD1 set in the last setup processing while skipping the setup processing requiring the certain period of time.

Next, when the controller 60 determines in step 201 that the thick-paper mode is set, the controller 60 sets the second process speed PS2 (S215). Then, the controller 60 determines whether or not the process speed PS has been changed after the last image formation (S216).

When the controller 60 determines in step 216 that the second process speed PS2 is set as a result of the change of the process speed PS, the controller 60 functions as an example of a determination unit, and determines whether or not the setup processing is performed according to whether or not the measured value of the cumulative number of printed sheets after the last setup processing is performed at the second process speed PS2 based on the measured value of the sheet-number counter CNT2 for the second process speed PS2 (S217). In other words, the controller 60 determines whether or not the measured value of the cumulative number of printed sheets of each of the sheet-number counters CN1 and CN2 after the last setup processing at the second process speed PS2 reaches the predetermined value. When the measured value of the cumulative number of printed sheets reaches the predetermined value, the controller 60 starts the setup processing. Here, when a long time elapsed since the last image formation, the image density is likely to vary largely. For addressing the variation of the image density, "the predetermined value" in step 217 may be set to be shorter than the predetermined number of printed sheets (the interval) set for performing the setup processing during the image forming operation at the second process speed PS2 or the ending setup processing.

When the setup processing is started, the controller 60 firstly stores, in the EEPROM 604, the output light amount value LD1 of the semiconductor laser 27 at the first process speed PS1 that is set in the last image formation (S218). Subsequently, the controller 60 generates the reference density patterns (see FIG. 3) (S219), and the density values thereof are detected for each color by the reference density detection sensor 55 (S220). Then, the controller 60 compares the detected density values of the reference density patterns for each color with the target values (the target values 2) for the image densities at the second process speed PS2 stored in the EEPROM 604 (S221).

By using the output light amount table determining the correspondences of the output light amount with the detected humidity value, the detected temperature value and the difference between each of the detected density values and the target values 2, the controller 60 calculates the output light amount value LD2 of the semiconductor laser 27 for irradiating the photosensitive drum 31 from the laser-exposure unit 26 (S222). Then, the calculated output light amount value LD2 is stored in the EEPROM 604 (S223). Moreover, the output light amount of the semiconductor laser 27 is set to the calculated output light amount value LD2, and the sheet-number counter CNT2 for the second process speed PS2 is reset to "0" (S224).

Additionally, the controller 60 sets the setup flag to "0" (S225).

As described above, in the image forming apparatus 1 of the first exemplary embodiment, when the image forming apparatus 1 is started up, if the cumulative number of printed sheets after the last setup processing at the second process speed PS2 reaches the predetermined number of printed sheets, the controller 60 newly performs the setup processing to set the various image forming conditions.

The sheet-number counter CNT1 for the first process speed PS1 is reset to "0" when the setup processing at the first process speed PS1 is performed, and thereby measuring the cumulative number of printed sheets after the last setup processing at the first process speed PS1. In addition, the sheet-number counter CNT2 for the second process speed PS2 is reset to "0" when the setup processing at the second process speed PS2 is performed, and thereby measuring the cumulative number of printed sheets after the last setup processing at the second process speed PS2. Alternatively, the controller 60 may be provided with a sheet-number counter CNT, a first storing unit and a second storing unit. The sheet-number counter CNT collectively measures the cumulative number for the first process speed PS1 and the second process speed PS2 without being reset to 0. The first storing unit stores the cumulative value of the sheet-number counter CNT at the time of the setup processing performed at the first process speed PS1, and the second storing unit stores the cumulative value of the sheet-number counter CNT at the time of the setup processing performed at the second process speed PS2. Then, the cumulative number of printed sheets after the last setup processing performed at the first process speed PS1 may be measured, by obtaining a difference between the cumulative value of the sheet-number counter CNT at the time of the setup processing performed at the first process speed PS1 and the cumulative value of the sheet-number counter CNT at the time when the speed is changed to the first process speed PS1.

On the other hand, when the measured value of the sheet-number counter CNT2 for the second process speed PS2 shows that the measured value of the cumulative number of printed sheets after the execution of the last setup processing does not reach the predetermined value in step 217, the setup processing is not performed. In this case, the processing of setting the output light amount LD2 of the semiconductor laser 27 is performed in the method shown in FIG. 9B (S226).

Moreover, when the controller 60 determines in step 216 that the process speed PS has not been changed since the last image formation, the controller 60 sets, as the output light amount of the semiconductor laser 27, the output light amount value LD2 stored in the EEPROM 604 during the last setup processing without any modification (S227). In this case, similarly, the image density is not likely to vary largely. Accordingly, the productivity of the image formation is improved by using the output light amount value LD2 set in the last setup processing while skipping the setup processing requiring the certain period of time.

Figure 10A:
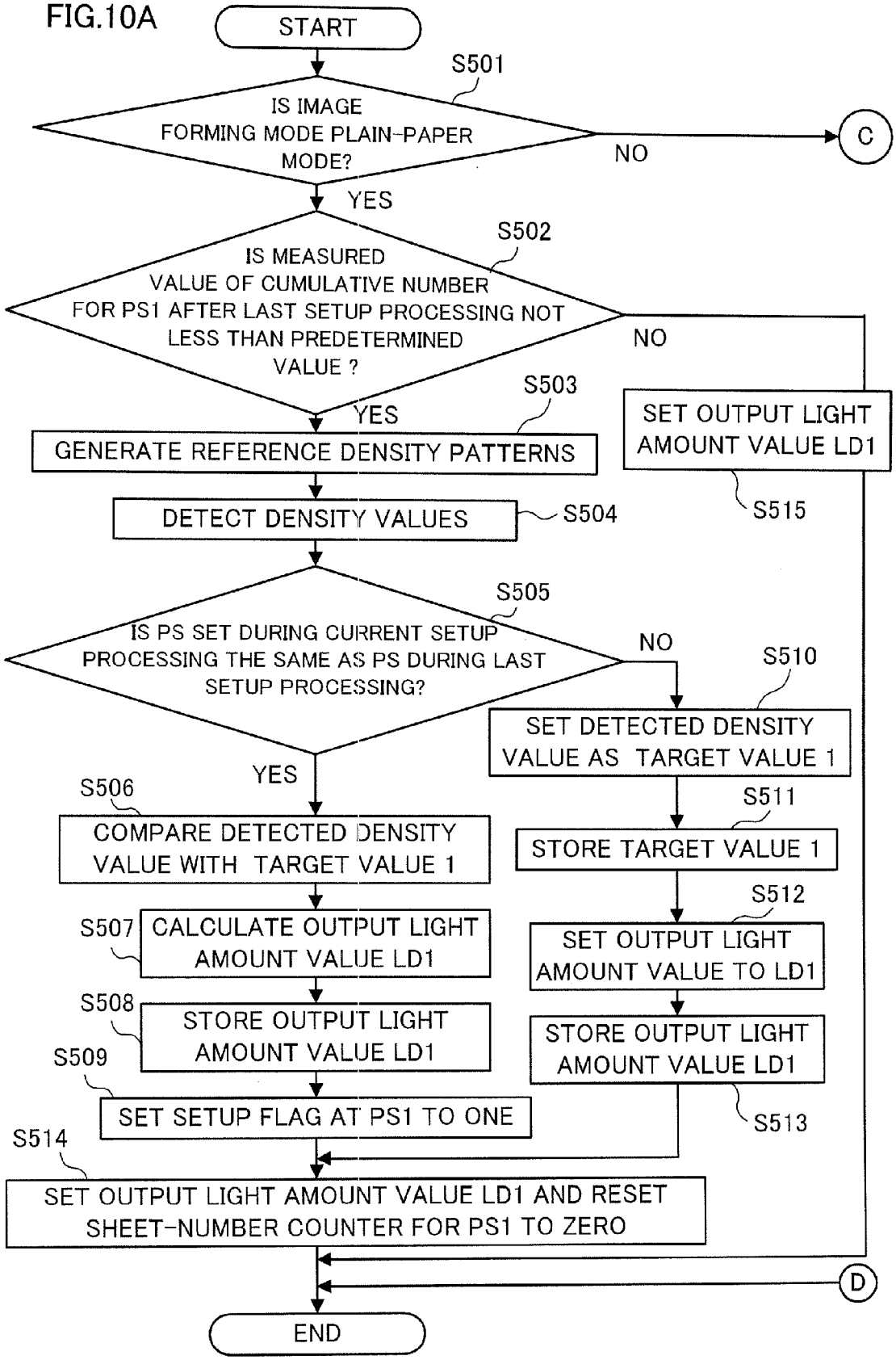
FIG. 10 consisting of 10A and 10B is a flowchart showing an example of the procedure in which the controller determines whether or not the setup processing during the image forming operation is performed.
Figure 10B:
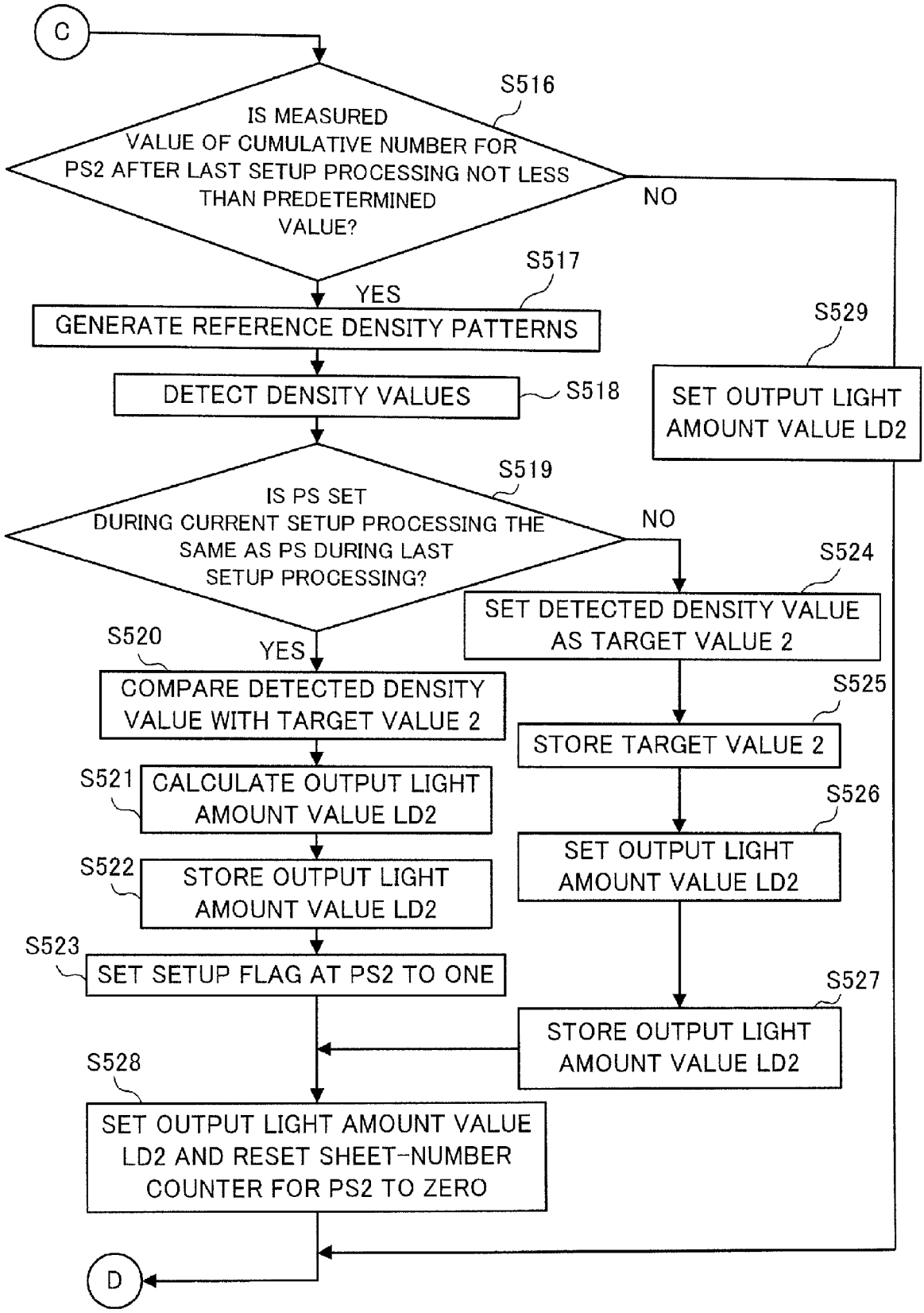

Next, FIG. 10 is a flowchart showing an example of the procedure in which the controller 60 determines whether or not the setup processing during the image forming operation is performed. As shown in FIG. 10, in the setup processing during the image forming operation, the controller 60 firstly determines the set image forming mode (S501). When the controller 60 determines in step 501 that the first process speed PS1 is set by setting the plain-paper mode, the controller 60 determines whether or not the measured value of the cumulative number of printed sheets after the last setup processing at the first process speed PS1 is not less than the predetermined value according to the measured value of the sheet-number counter CNT1 for the first process speed PS1 (S502). In other words, the controller 60 determines whether or not the cumulative number of printed sheets for the first process speed PS1 and the second process speed PS2 after the last setup processing at the first process speed PS1 reaches the predetermined number of printed sheets. When the measured value of the cumulative number of printed sheets reaches the predetermined value, the controller 60 starts the setup processing. "The predetermined value" here is, for example, the predetermined number of printed sheets set as the interval of performing the setup processing during the image forming operation at the first process speed PS1.

When the setup processing is started, the controller 60 generates the reference density patterns (see FIG. 3) (S503) and the density values thereof are detected for each color by the reference density detection sensor 55 (S504). Then, the controller 60 determines whether or not the first process speed PS1 set during the current setup processing is the same as the process speed PS set during the last setup processing (S505).

When determining in step 505 that the first process speed PS1 is the same as the process speed PS set during the last setup processing, the controller 60 compares the detected density value of each color reference density pattern detected by the reference density detection sensor 55, with the target value 1 for the image density at the first process speed PS1 stored in the EEPROM 604 inside the controller 60 (S506). Then, by using the output light amount table determining the correspondences of the output light amount with the detected humidity value, the detected temperature value and the difference between each of the detected density values and the target value 1, the controller 60 calculates the output light amount value LD1 of the semiconductor laser 27 for irradiating the photosensitive drum 31 from the laser-exposure unit 26 (S507). The calculated output light amount value LD1 is stored in the EEPROM 604 inside the controller 60 (S508).

Further, the controller 60 sets the setup flag to "1" (S509). More specifically, since the setup processing in step 506 and 507 is the second or subsequent setup processing at the first process speed PS1 at the state where the setup processing at the process speed PS2 is not performed, the setup flag is set to "1."

On the other hand, when determining in step 505 that the first setup processing speed PS1 is different from the process speed PS set during the last setup processing, that is, when the process speed PS has been changed, the controller 60 sets the detected density value of each color reference density pattern detected by the reference density detection sensor 55 as the target value (the target value 1) for the image density (S510), and stores the target value 1 in the EEPROM 604 inside the controller 60 (S511). Thereafter, the controller 60 determines that the output light amount value of the semiconductor laser 27 is set to the output light amount value LD1 that allows the image density to be the target value 1 (S512), and then stores the output light amount value LD1 in the EEPROM 604 inside the controller 60 (S513).

The controller 60 sets the output light amount value LD1 determined in step 507 or 512, as the output light amount value LD1 of the semiconductor laser 27, and resets the sheet-number counter CNT1 for the first process speed PS1 to "0" (S514).

As described above, in the process 510, when the process speed PS is changed as a result of the change in the setting of the image forming mode, the detected density value of each color reference density pattern in the first setup processing at the newly-set first process speed PS1 is set as the target value 1 for the image density at the newly-set first process speed PS1. This setting reduces the variation in image density in the same image forming mode. In addition, this shortens the time required to correct the image forming conditions, and thereby the productivity of image formation is enhanced.

Here, return to step 502. When, according the measured value of the sheet-number counter CNT1 for the first process speed PS1, the measured value of the cumulative number of printed sheets after the last setup processing performed is determined not to reach the predetermined value, the setup processing is not performed. In this case, the processing of setting the output light amount LD1 of the semiconductor laser 27 is performed, for example, in the method shown in FIG. 9A (S515).

Here, the state quantity (the output light amount LD of the semiconductor laser 27) is set in consideration of a variation in the light amount at the time of the change of the process speed PS, and thereby the output light amount LD1 of the semiconductor laser 27 that leads to a small amount of variation in the image density is set in the simple manner. In addition, the output light amount LD1 of the semiconductor laser 27 is set quickly, and accordingly the productivity of image formation is improved.

It should be noted that, besides the method shown in FIG. 9A, the setting processing in step 515 may also employ another method in which the output light amount LD1 stored in the EEPROM 604 in the last setup processing is set as the output light amount of the semiconductor laser 27 without any modification. In this case, similarly, since it is considered that the image density may not vary to a large extent, the productivity of image formation is improved by using the last-set output light amount LD1.

Here, the measured value of the sheet-number counter CNT1 for the first process speed PS1 is also usable to determine which of the method shown in FIG. 9A and the method using the last-set output light amount LD1 is employed. More specifically, the controller 60 may be configured to employ the method shown in FIG. 9A when the measured value of the sheet-number counter CNT1 is not less than the predetermined value, while employing the method using the last-set output light amount LD1 when the measured value is less than the predetermined value.

On the other hand, when the controller 60 determines in step 501 that the second process speed PS2 is set by setting the thick-paper mode, the controller 60 determines whether or not the measured value of the cumulative number of printed sheets after the last setup processing is not less than a predetermined value according to the measured value of the sheet-number counter CNT2 for the second process speed PS2 (S516). In other words, the controller 60 determines whether or not the measured value of the cumulative number of printed sheets for the second process speed PS2 and the first process speed PS1 after the last setup processing at the second process speed PS2 reaches the predetermined number of printed sheets. When the measured value of the cumulative number of printed sheets reaches the predetermined value, the controller 60 starts the setup processing. "The predetermined value" here is, for example, the predetermined number of printed sheets set as the interval of performing the setup processing during the image forming operation at the second process speed PS2. Moreover, in this case, the interval may be set to have a length different from a length of the interval of performing the setup processing during the image forming operation at the first process speed PS1.

When the setup processing is started, the controller 60 generates the reference density patterns (see FIG. 3) (S517) and the density values thereof are detected for each color by the reference density detection sensor 55 (S518). Then, the controller 60 determines whether or not the second process speed PS2 set during the current setup processing is the same as the process speed PS set during the last setup processing (S519).

When the controller 60 determines in step 519 that the second setup processing speed PS2 is the same as the process speed PS set during the last setup processing, the controller 60 compares the detected density value of each color reference density pattern detected by the reference density detection sensor 55, with the target value 2 for the image density at the second process speed PS2 stored in the EEPROM 604 inside the controller 60 (S520). Then, by using the output light amount table determining the correspondences of the output light amount with the detected humidity value, the detected temperature value and the difference between each of the detected density values and the target value 2, the controller 60 calculates the output light amount value LD2 of the semiconductor laser 27 for irradiating the photosensitive drum 31 from the laser-exposure unit 26 (S521). The calculated output light amount value LD2 is stored in the EEPROM 604 inside the controller 60 (S522).

Further, the controller 60 sets the setup flag to "1" (S523). More specifically, since the setup processing in step 520 and 521 is the second or subsequent setup processing at the second process speed PS2 in the state where the setup processing is not performed at the process speed PS1, the setup flag is set to "1."

On the other hand, when the controller 60 determines in step 519 that the second setup processing speed PS2 is different from the process speed PS set during the last setup processing, that is, when the process speed PS has been changed, the controller 60 sets the detected density value of each color reference density pattern detected by the reference density detection sensor 55 as the target value (the target value 2) for the image density (S524), and stores the target value 2 in the EEPROM 604 inside the controller 60 (S525. Thereafter, the controller 60 determines that the output light amount value of the semiconductor laser 27 is set to the output light amount value LD2 that allows the image density to be the target value 2 (S526), and then stores the output light amount value LD2 in the EEPROM 604 inside the controller 60 (S527).

The controller 60 sets the output light amount value LD2 calculated in step 521 or determined in step 526, as the output light amount value LD2 of the semiconductor laser 27, and resets the sheet-number counter CNT2 for the second process speed PS2 to "0" (S528).

In this case, similarly, when the process speed PS is changed as a result of the change in the setting of the image forming mode in step 524, the detected density value of each color reference density pattern in the first setup processing at the newly-set process speed PS is set as the target value 2 for the image density at the newly-set process speed PS. This setting reduces the variation in image density in the same image forming mode. In addition, this shortens the time required to correct the image forming conditions, and thereby the productivity of image formation is enhanced.

Here, return to step 516. When, according the measured value of the sheet-number counter CNT2 for the second process speed PS2, the measured value of the cumulative number of printed sheets after the last setup processing performed is determined not to reach the predetermined value, the setup processing is not performed. In this case, the processing of setting the output light amount LD2 of the semiconductor laser 27 is performed, for example, in the method shown in FIG. 9B (S529).

Here, the state quantity (the output light amount LD of the semiconductor laser 27) is set in consideration of a variation in the light amount at the time of the change of the process speed PS, and thereby the output light amount LD2 of the semiconductor laser 27 that leads to a small amount of variation in the image density is set in the simple manner. In addition, the output light amount LD2 of the semiconductor laser 27 is set quickly, and accordingly the productivity of image formation is improved.

It should be noted that, besides the method shown in FIG. 9B, the setting processing in step 529 may also employ another method in which the output light amount LD2 stored in the EEPROM 604 in the last setup processing is set as the output light amount of the semiconductor laser 27 without any modification. In this case, similarly, since it is considered that the image density may not vary to a large extent, the productivity of image formation is improved by using the last-set output light amount LD2.

Here, the measured value of the sheet-number counter CNT2 for the second process speed PS2 is also usable to determine which of the method shown in FIG. 9B and the method using the last-set output light amount LD2 is employed. More specifically, the controller 60 may be configured to employ the method shown in FIG. 9B when the measured value of the sheet-number counter CNT2 is not less than the predetermined value, while employing the method using the last-set output light amount LD2 when the measured value is less than the predetermined value.

Subsequently, the determination processing of the ending setup processing is performed in the substantially same manner as the determination processing of the setup processing during the image forming operation shown in FIG. 10. In the determination processing of the ending setup processing, "the predetermined value" used for the determination in step 502 shown in FIG. 10 may be set to be shorter than the interval of performing the setup processing during the image forming operation at the first process speed PS1 in consideration of a case where the image forming apparatus 1 will not be in use for a long time until the next image formation. Similarly, "the predetermined value" used for the determination in step 516 may be set to be shorter than the interval of performing the setup processing during the image forming operation at the second process speed PS2.

It should be noted that, although the image forming apparatus 1 of the first exemplary embodiment uses the certain number of printed sheets as the state representing the elapsed period to set the interval for each of the start-up setup processing, the setup processing during image forming operation and the ending setup processing, the interval for each setup processing may be set by using another state representing the elapsed period. Other examples of the state include an elapsed time after the execution of the last setup processing, an image forming period of the image forming unit 30, a driving period of the photosensitive drum 31, and a driving period of the developing unit 33. In addition, if the environment such as the temperature and humidity changes over a certain range, if a member that is a constituent factor determining the image forming conditions is exchanged for a new one, if the two component developer is exchanged for a new one, or otherwise, the preconditions for setting the image forming conditions change largely while the power of the image forming apparatus 1 is on. For this reason, the image forming apparatus 1 may be configured to perform the setup processing in the first image formation after the process speed PS is changed.

Hereinafter, more detailed descriptions will be given for the point that each kind of the setup processing is performed when the value of the cumulative number of printed sheets measured by the sheet-number counter CNT1 or CNT2 reaches the certain interval determined for the process speed PS1 or PS2.

Figure 11:
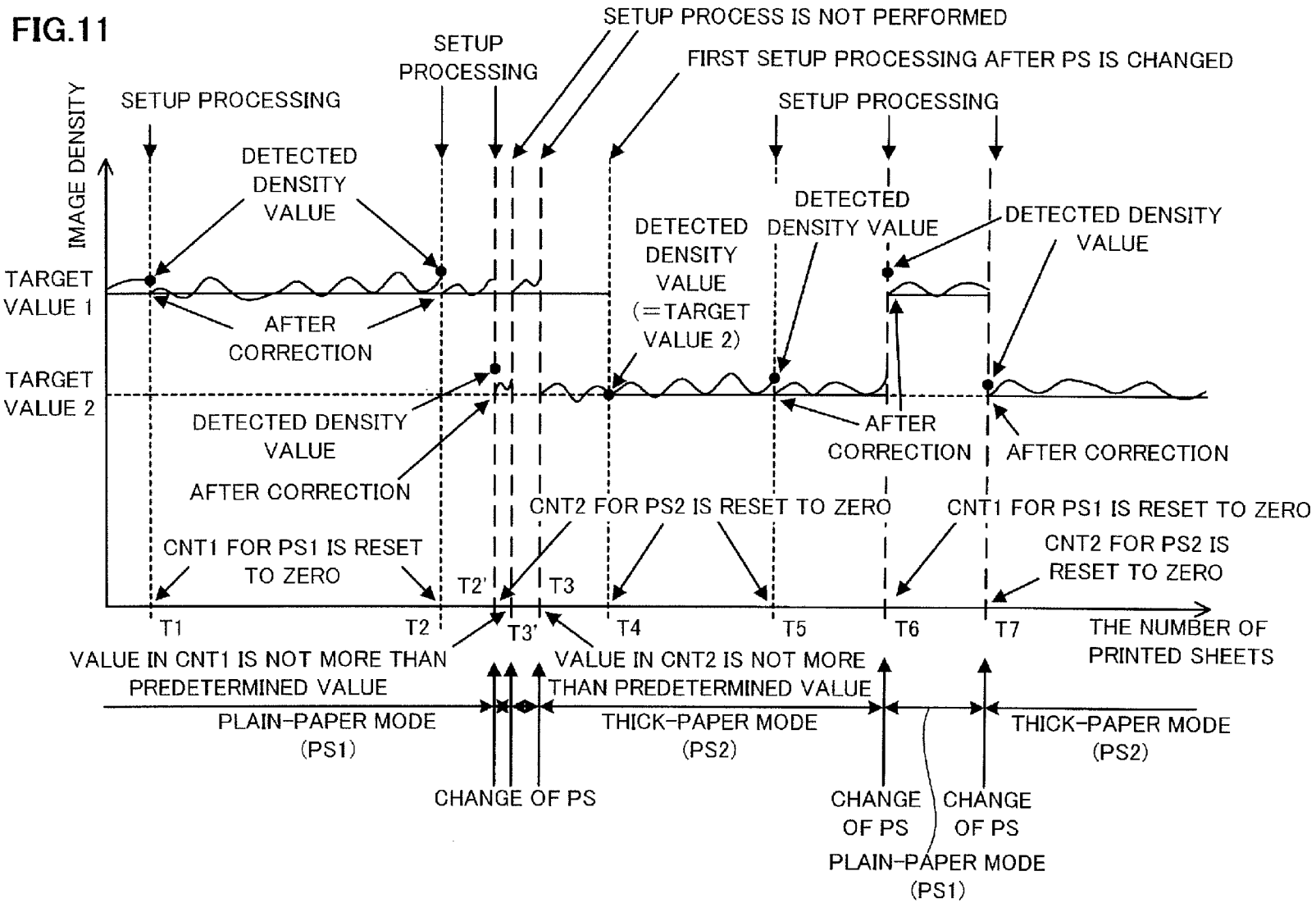
FIG. 11 is a diagram explaining timings of performing the setup processing during the image forming operation (here, also simply called a "setup processing")

FIG. 11 is a diagram explaining timings of performing the setup processing during the image forming operation (here, also simply called a "setup processing"). The descriptions will be given in chronological order by use of FIG. 11. At first, at a time T1, the setup processing for a state where the first process speed PS1 of the plain-paper mode is set is performed, for example. Here, the setup processing at the time T1 is assumed to be the second or subsequent setup processing after the first process speed PS1 is set. Accordingly, at the time T1, the following setup processing is performed. Specifically, the detected density value of each color reference density pattern detected by the reference density detection sensor 55 is compared with the target value 1 for the image density at the first process speed PS1 stored in the EEPROM 604 inside the controller 60. Then, according to the comparison result, the detected humidity value and the detected temperature value, the output light amount value LD1 of the semiconductor laser 27 is corrected such that the image density would be the target value 1. At this time, the sheet-number counter CNT1 is reset to "0", and newly starts measuring the number of printed sheets.

Next, when the plain-paper mode is assumed to be kept, the next setup processing is performed at a time T2 when the measured value of the cumulative number of printed sheets for the first process speed PS1 by the sheet-number counter CNT1 reaches the interval for the setup processing at the first process speed PS1. At the time T2, the setup processing is performed in the same procedure as that at the time T1. At this time, the sheet-number counter CNT1 is reset to "0", and newly starts measuring the number of printed sheets.

Thereafter, the mode is assumed to be changed to the thick-paper mode (the second process speed PS2) at a time T2'. In this case, at the time T2', the measured value of the cumulative number of printed sheets in the sheet-number counter CNT2 for the second process speed PS2 is assumed to reach the interval for the setup processing at the second process speed PS2. For this reason, the detected density value of each color reference density pattern of the reference density detection sensor 55 is compared with the target value 2 for the image density at the second process speed PS2 stored in the EEPROM 604 inside the controller 60. Then, according to the comparison result, the detected humidity value and the detected temperature value, the output light amount of the semiconductor laser 27 is corrected to the output light amount LD2 that allows the image density to be the target value 2. At this time, the sheet-number counter CNT2 is reset to "0" and the measurement of the number of printed sheets newly starts.

Subsequently, the mode is assumed to be changed to the plain-paper mode (the first process speed PS1) at a time T3'. Since, at the time T3', the sheet-number counter CNT1 for the first process speed PS1 is reset to "0" at the time T2, the measured value of the cumulative number of printed sheets in the sheet-number counter CNT1 is assumed not to reach the interval for the setup processing at the first process speed PS1 (is not more than the predetermined value) at the time T3'. Accordingly, at the time T3', the setup processing is not performed.

Moreover, the plain-paper mode (the first process speed PS1) is assumed to be changed to the thick-paper mode (the second process speed PS2) at a time T3 that is a time before the measured value of the cumulative number of printed sheets in the sheet-number counter CNT1 reaches the interval for the setup processing. The measured value of the cumulative number of printed sheets in the sheet-number counter CNT2 does not reach the interval for the setup processing at the second process speed PS2 (is not more than the predetermined value) at the time T3. In this case, the setup processing is not performed at the time T3. Here, the aforementioned simple processing of setting the state quantity is performed. At this time, the sheet-number counter CNT2 is not reset to "0" and the measurement of the number of printed sheets continues.

At a time T4 when the measured value of the cumulative number of printed sheets of the sheet-number counter CNT2 reaches the interval for the setup processing at the second process speed PS2, the first setup processing after the change to the second process speed PS2 is performed. Accordingly, at the time T4, the following setup processing is performed. Specifically, the detected density value of each color reference density patterns detected by the reference density detection sensor 55 is set as the target value 2 for the image density and the target value 2 is stored in the EEPROM 604 inside the controller 60. Then, the output light amount value LD2 of the semiconductor laser 27 that allows the image density to be the target value 2 is set. Moreover, at this time, the sheet-number counter CNT2 is reset to "0."

After the setup processing at a time T4, the next setup processing is performed at a time T5 that is a time when the measured value of the cumulative number of printed sheets in the sheet-number counter CNT2 for the second process speed PS2 reaches the interval for the setup processing at the second process speed PS2 while the thick-paper mode is continuously set. The setup processing at the time T5 is performed in the same procedure as at the times T1 and T2. In addition, the sheet-number counter CNT2 is reset to "0" at the time T5.

Thereafter, the thick-paper mode (the second process speed PS2) is change to the plain-paper mode (the first process speed PS1) at a time T6 that is a time before the measured value of the cumulative number of printed sheets in the sheet-number counter CNT2 reaches the interval for the setup processing. At this time (time T6), the measured value of the cumulative number of printed sheets in the sheet-number counter CNT1 for the first process speed PS1 reaches the interval for the setup processing for the first process speed PS1. For this reason, the setup processing is performed at the time T6. More precisely, at the time T6, the detected density value of each color reference density pattern of the reference density detection sensor 55 is compared with the target value 1 for the image density at the first process speed PS1 stored in the EEPROM 604 inside the controller 60. Then, according to the comparison result, the detected humidity value and the detected temperature value, the output light amount of the semiconductor laser 27 is corrected to the output light amount LD1 that allows the image density to be the target value 1. At this time, the sheet-number counter CNT1 is reset to "0" and the measurement of the number of printed sheets newly starts.

Subsequently, after the setup processing at the time T6, the plain-paper mode (the first process speed PS1) is assumed to be again changed to the thick-paper mode (the second process speed PS2) at a time T7 that is a time before the measured value of the cumulative number of printed sheets in the sheet-number counter CNT1 reaches the interval for the setup processing. At this time (time T7), the measured value of the cumulative number of printed sheets in the sheet-number counter CNT2 for the second process speed PS2 is assumed to reach the interval for the setup processing at the second process speed PS2. For this reason, the setup processing is performed at the time T7. More precisely, at the time T7, the detected density value of each color reference density pattern of the reference density detection sensor 55 is compared with the target value 2 for the image density at the second process speed PS2 stored in the EEPROM 604 inside the controller 60. Then, according to the comparison result, the detected humidity value and the detected temperature value, the output light amount of the semiconductor laser 27 is corrected to the output light amount LD2 that allows the image density to be the target value 2. At this time, the sheet-number counter CNT2 is reset to "0" and the measurement of the number of printed sheets newly starts.

As described above, the controller 60 of the first exemplary embodiment performs the setup processing at a time when the value of the cumulative number of printed sheets measured by the sheet-number counter CNT1 or CNT2 reaches the certain interval determined for the process speed PS1 or PS2. Moreover, when the setting of the process speed PS is changed, the setup processing is performed on condition that the value of the cumulative number of printed sheets measured by the sheet-number counter CNT1 or CNT2 reaches the certain interval determined for the process speed PS1 or PS2 to which the process speed PS is changed. Accordingly, when the setting of the process speed PS is changed, and if the cumulative number does not reach the certain interval, the setup processing is not performed.

In addition, the sheet-number counter CNT1 or CNT2 is reset to "0" when the setup processing is performed, and newly starts measuring the number of printed sheets. Hence, even if the setup processing is performed when the setting of the processing speed PS is changed, the setup processing at each of the process speeds PS is not performed at an interval shorter than that determined for the process speeds PS1 or PS2.

Thereby, in the image forming apparatus 1 of the first exemplary embodiment, the timings of performing the setup processing are optimized and thus the productivity in image forming processing is improved.

Figure 12A:
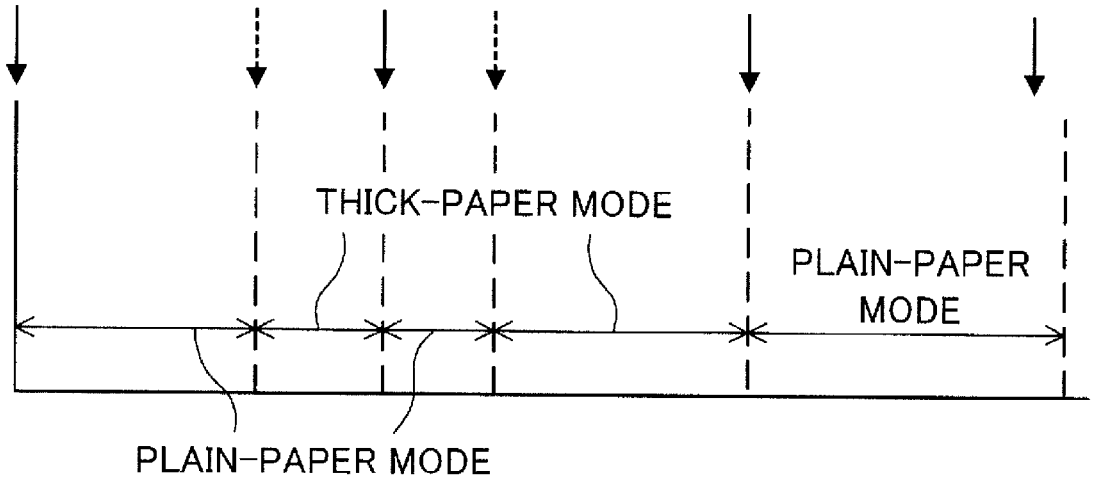
FIG.12A RELATED ART
FIGS. 12A to 12C are diagrams in which the conventional timings of performing the setup processing are compared with the timings of performing the setup processing in the first exemplary embodiment.
Figure 12B:
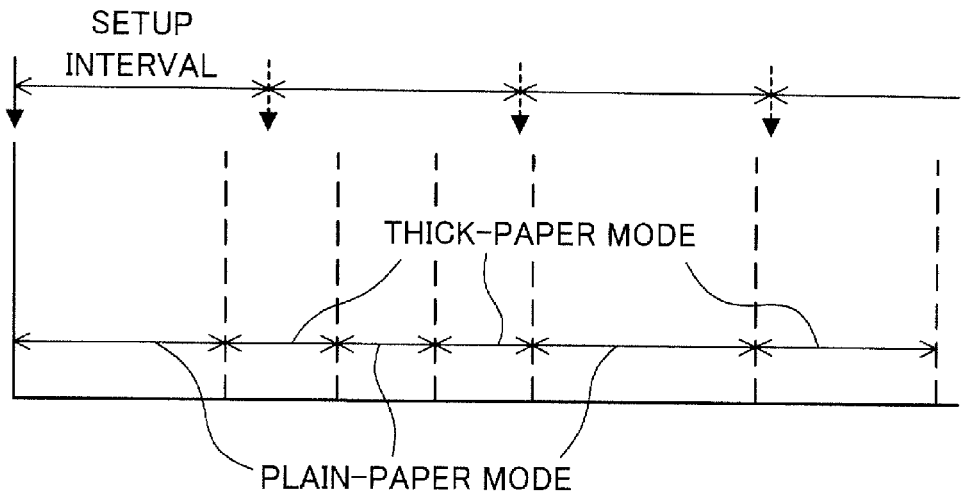
Figure 12C:
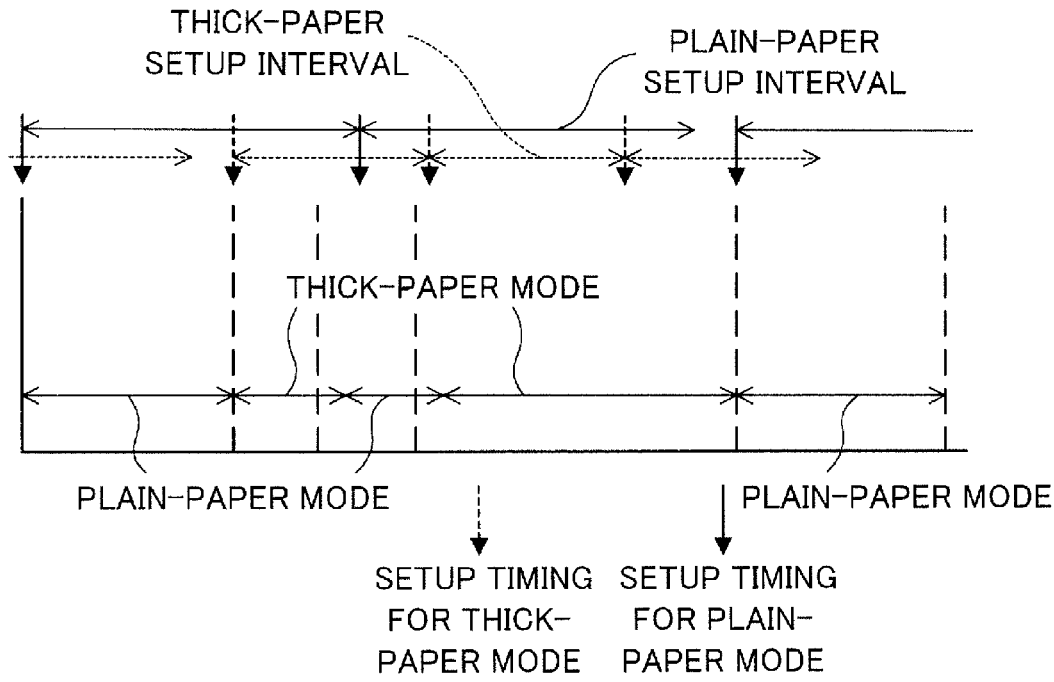

Here, FIGS. 12A to 12C are diagrams in which the conventional timings of performing the setup processing are compared with the timings of performing the setup processing in the first exemplary embodiment. FIG. 12A shows the conventional case where the setup processing is performed every time the process speed PS is changed. In this method, productivity in image forming processing deteriorates due to an increase in the frequency of the setup processing requiring a certain period of time. Then, FIG. 12B shows the case where the setup processing is performed at intervals collectively set for both of the modes, regardless of whether the process speed PS is changed or not. In this method, there is a case where the setup processing is performed at the timings only in one of the modes (for example, the thick-paper mode) for a long time. In this case, the setup processing may not be performed even when the setup processing is required in the other mode (for example, the plain-paper mode). This sometimes results in an increase of variations in image density and tone.

In contrast, in the first exemplary embodiment shown in FIG. 12C, the setup processing is performed after, for example, every certain number of printed sheets (interval) set for each of the process speeds PS. In addition, once the setup processing is performed, the sheet-number counter CNT1 or CNT2 is reset to "0" and newly starts measuring the cumulative number of printed sheets after the last setup processing up to the certain number. Then, when the certain interval is elapsed, the setup processing is also performed at the time of the change of the process speed PS. This prevents an occurrence of a situation in which the setup processing is not performed for a long time in any one of the modes. Moreover, the frequency of the setup processing requiring the certain period of time is also reduced.

Heretofore, the descriptions has been described for the case where the controller 60 of the first exemplary embodiment generates the reference density patterns for each color as the state quantities each indicating the state of an image formed by a corresponding one of the image forming units 30, and then performs the setup processing by using the detected density value of each color reference density pattern of the reference density detection sensor 55. However, it should be noted that other kinds of state quantities each indicating the state of an image are usable to perform the setup processing, in addition to the detected density values of the reference density patterns for each color. One usable state quantity is the surface potential of the photosensitive drum 31 that is detected by the potential sensor 68 and indicates the state of an electrostatic latent image formed on the photosensitive drum 31. Instead, though not being exactly the state quantity indicating the state of an image, the surface potential of the photosensitive drum 31 is also usable which is detected after the photosensitive drum 31 is charged by the charging roll 32 and before an electrostatic latent image is formed. As the surface potential, a dark area potential, an intermediate potential and a light area potential which are latent image potentials, are usable. In this case, as the image forming conditions, controlled are the output light amount value of the semiconductor laser 27 in the laser-exposure unit 26, the value of the charge bias voltage supplied to the charging roll 32, and the value of the developing bias voltage applied to the developing roll 34.

Moreover, the toner density detection value detected by the toner density sensor 69, which is an example of a density detecting unit, is also usable, though it is also not the state quantity indicating the state of an image. In this case, as the image forming conditions, controlled are the output light amount value of the semiconductor laser 27 in the laser-exposure unit 26, the value of the charge bias voltage supplied to the charging roll 32, the value of the developing bias voltage applied to the developing roll 34, and the correction amounts of color toners refilled in the respective developing units 33.

The toner density detection value detected by the toner density sensor 69 is outputted as different values before and after the change of the process speed PS because the rotation speeds of the developing roll 34 and a conveyance screw (not illustrated in the figure) in each of the developing units 33 are changed with the change of the process speed PS.

In addition, the setup processing may be performed by using, as the state quantity indicating the state of an image, at least one of a detected density value and a detected color value of each of reference density patterns for each color formed on the paper sheet P. In this case, as the image forming conditions, controlled are the output light amount value of the semiconductor laser 27 in the laser-exposure unit 26, the value of the charge bias voltage supplied to the charging roll 32, the value of the developing bias voltage applied to the developing roll 34, the surface temperature and the fixing speed of the fixing roll 82 of the fixing unit 80 and the value of the transfer bias voltage applied to the first transfer roll 42.

It should be noted that an employable method of forming the reference density patterns for each color on the intermediate transfer belt 41 or the paper sheet P is a method in which the controller 60 forms the patterns by reading reference density pattern data stored in the main storing unit 90, a method in which the controller 60 forms the patterns by reading a certain reference density chart from the image capturing apparatus 4, or another equivalent method.

Further, for example, every time the first process speed PS1 is changed to the second process speed PS2 for making prints with thick paper, glossy paper or the like, the image forming apparatus 1 of the first exemplary embodiment may perform the setup processing regardless of whether or not the measured value of the cumulative number of printed sheets in the sheet-number counter CNT2 reaches the certain interval. This is because the image quality is preferentially required in such a case. Moreover, paper types for which image quality is considered more important and paper types for which productivity is considered more important are different between customers. For this reason, in this case, the image forming apparatus 1 may be configured to allow any one of the first process speed PS1 and the second process speed PS2 to be selected as the process speed PS for which the setup processing is performed every time of speed change.

As has been described above, the image forming apparatus 1 of the first exemplary embodiment has the configuration in which the interval is set for performing the setup processing at each of the process speeds PS, and in which the setup processing is performed at the time when, for example, the measured value of the cumulative number of printed sheets reaches the interval determined for each of the process speeds PS. Moreover, when the setting of the process speed PS is changed, the setup processing is performed on condition that the value of the cumulative number of printed sheets measured by the sheet-number counter CNT1 or CNT2 reaches the certain interval determined for the process speed PS1 or PS2 to which the process speed PS is changed. Accordingly, when the setting of the process speed PS is changed, and if the cumulative number does not reach the certain interval, the setup processing is not performed. In addition, the sheet-number counter CNT1 or CNT2 is reset to "0" when the setup processing is performed and newly starts measuring the number of printed sheets. Thereby, the timings of performing the setup processing are optimized and productivity of image formation is improved. Furthermore, image density and tone are prevented from largely varying.

Second Exemplary Embodiment

The first exemplary embodiment provides the description for the configuration in which, in the case where the process speed PS is changed, whether to execute the setup processing is determined according to whether or not the measured value of the sheet-number counter CNT for each of the process speeds PS reaches the predetermined value. This measured value may be the number of printed sheets or a time accumulated at each of the first and second process speeds PS1 and PS2. In the second exemplary embodiment, descriptions will be provided for a configuration in which whether to execute the setup processing is determined according to whether or not a calculated value of the sheet-number counter CNT for each of the process speeds PS reaches a predetermined value. Here, the calculated value is the cumulative number of printed sheets, time or the like calculated by weighting the respective measured values of the sheet-number counters CNT1 and CNT2 for the first and second process speeds PS1 and PS2. Incidentally, the same reference numerals are given to the same components as those in the first exemplary embodiment, and the detailed explanations thereof are omitted here.

For example, in steps 204 and 217 in the start-up setup processing shown in FIG. 8 and in steps 502 and 516 in the setup processing during image formation operation and the ending setup processing shown in FIG. 10 in the first exemplary embodiment, the controller 60 of the second exemplary embodiment determines whether or not to execute the setup processing as follows.

More specifically, the controller 60 of the second exemplary embodiment executes calculation processing of differently weighting the measured value in the operation at the first process speed PS1 and the measured value in the operation at the second process speed PS2. Then, the controller 60 determines whether or not to execute the setup processing while regarding the calculation result as the measured value of each of the sheet-number counters CNT1 and CNT2.

Figure 13:
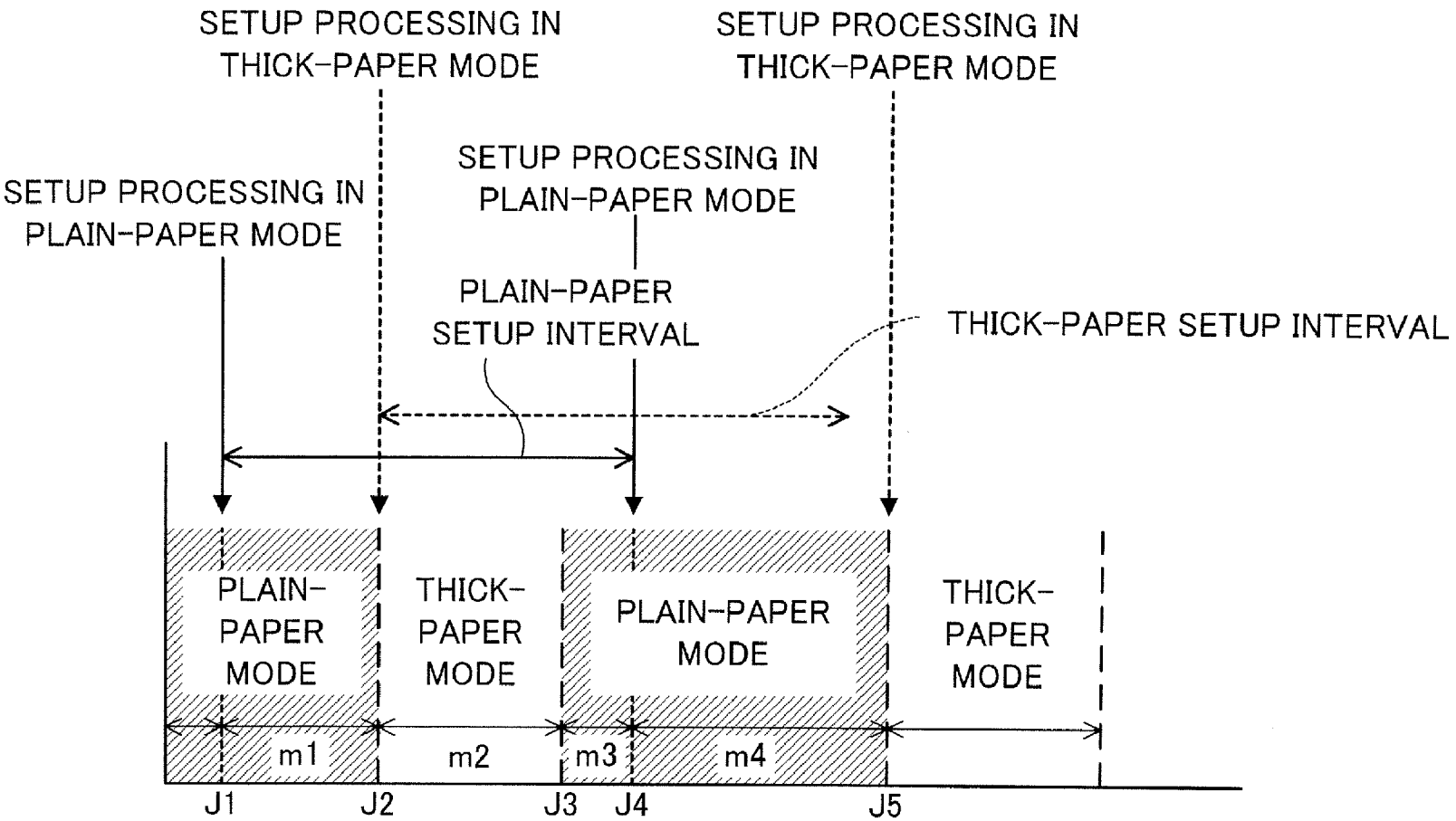
FIG. 13 is a diagram for explaining the processing in which the controller of the second exemplary embodiment determines whether to execute the setup processing.

Here, FIG. 13 is a diagram for explaining the processing in which the controller 60 of the second exemplary embodiment determines whether to execute the setup processing. In FIG. 13, the setup processing in the plain-paper mode (at the first process speed PS1) is assumed to be firstly performed at a time J1 and the setup processing in the thick-paper mode (at the second process speed PS2) is assumed to be performed at a time J2. Accordingly, the sheet-number counter CNT1 for the first process speed PS1 is reset to "0" at the time J1 and newly starts measuring the number. In addition, the sheet-number counter CNT2 for the second process speed PS2 is reset to "0" at the time J2 and newly starts measuring the number.

Thereafter, at a time J3, the thick-paper mode is assumed to be changed to the plain-paper mode. In this case, as the measured value of the number of printed sheets after the time J1 when the sheet-number counter CNT1 newly starts the measurement, the controller 60 uses a calculation result obtained by using the following equation 3. Specifically, a calculated measured value CNT1' of the sheet-number counter CNT1 at the time J3 is $$CNT1'=m1\times a1+m2\times b1 \quad (3).$$

Here, m1 denotes a measured value of the number of printed sheets in the plain-paper mode from the time J1 to the time J2, and m2 denotes a measured value of the number of printed sheets in the thick-paper mode from the time J2 to the time J3. Moreover, a1 and b1 are weighting coefficients, where $0<a1<1$ and $a1+b1=1$.

Then at the time J3 when the thick-paper mode is changed to the plain-paper mode, the controller 60 determines whether or not the calculated measured value CNT1' for the process speed PS1 exceeds a predetermined value. FIG. 13 shows a case where the calculated measured value CNT1' for the process speed PS1 is determined not to exceed the predetermined value at the time J3. For this reason, the controller 60 does not perform the setup processing at the time J3. It should be noted that, at the time J3, the state quantity is corrected by any one of the above-mentioned method shown in FIG. 9A, the method of directly setting the state quantity (the output light amount LD1 of the semiconductor laser 27 and the like) stored in the EEPROM 604 in the last setup processing at the time J1 and another equivalent method.

Then, the controller 60 performs the setup processing at a time J4 when the calculated measured value CNT1' for the first process speed PS1 exceeds the predetermined value (plain-paper setup interval).

Thereafter, at a time J5, the plain-paper mode is assumed to be changed to the thick-paper mode. In this case, as the measured value of the number of printed sheets after the time J2 when the sheet-number counter CNT2 newly starts the measurement, the controller 60 uses a calculation result obtained by using the following equation 4. Specifically, a calculated measured value CNT2' of the sheet-number counter CNT2 is $$CNT2'=m2\times b2+(m3+m4)\times a2 \quad (4).$$

Here, m3+m4 denotes a measured value of the number of printed sheets in the plain-paper mode from the time J3 to the time J5. Moreover, a2 and b2 are weighting coefficients, where $0<a2<1$ and $a2+b2=1$.

Then at the time J5 when the plain-paper mode is changed to the thick-paper mode, the controller 60 determines whether or not the calculated measured value CNT2' for the process speed PS2 exceeds a predetermined value. FIG. 13 shows a case where the calculated measured value CNT2' for the process speed PS2 is determined to exceed the predetermined value (thick-paper setup interval) at the time J5. For this reason, the controller 60 performs the setup processing at the time J5.

As described above, the controller 60 of the second exemplary embodiment uses, as the measured value of each of the sheet-number counters CNT1 and CNT2, the calculated measured value obtained through the calculation processing of differently weighting the measured value in the operation at the first process speed PS1 and the measured value in the operation at the second process speed PS2. Then, according to whether or not each of the calculated measured values CNT1' and CNT2' reaches the predetermined value set for a corresponding one of the plain-paper mode and the thick-paper mode, the controller 60 determines whether or not to execute the setup processing.

Thus, even in the case where the variation range of each state quantity differs between operation states at different process speeds PS, the timings of performing the setup processing are optimized.

The second exemplary embodiment describes the method of performing the setup processing at a newly-set process speed PS by using, as the target value for the image density, the detected density value of each color reference density pattern detected for the first time after the change of the process speed PS. As in the conventional case, however, the target value for the image density set before the change of the process speed PS may also be used as it is in the first setup processing after the change of the process speed PS. In the first setup processing after the change of the process speed PS, the image density level is adjusted to the original image density level different from that used after the change of the process speed PS, and this causes a variation in the image density level before and after the first setup processing. For this reason, it is preferable to reduce such a variation in the image density level by changing the target value for the image density in response to the change of the process speed PS. Moreover, like the second exemplary embodiment, it is more preferable that a variation in the image density level before and after the first setup processing after the change of the process speed PS is reduced by changing the target value according to the first density value detected after the change of the process speed PS.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image forming unit that forms an image on a medium according to an image forming condition;

a speed changing unit that changes an image forming speed of the image forming unit between a plurality of image forming speeds including a first image forming speed;

an adjusting unit that adjusts the image forming condition set in the image forming unit;

a measuring unit that measures an elapsed state after the image forming condition is adjusted for the last time at the first image forming speed in the image forming unit, and outputs a measured value indicative of the elapsed state;

a determination unit that determines, according to the elapsed state, whether or not to adjust the image forming condition before the image forming unit starts forming an image at the first image forming speed, the elapsed state measured by the measuring unit at the time when the speed changing unit changes the image forming speed to the first image forming speed, wherein the measuring unit measures the elapsed state after the adjusting unit adjusts the image forming condition, and in a case where the determination unit determines not to adjust the image forming condition when the speed changing unit changes the image forming speed to the first image forming speed, the measuring unit measures a total sum (A+B) of the measured value (A) indicative of the elapsed state at the first image forming speed after the change of the image forming speed, and the measured value (B) indicative of the elapsed state after the last adjustment of the image forming condition at the first image forming speed before the change of the image forming speed, and the adjusting unit adjusts the image forming condition when the total sum reaches a certain value.

2. The image forming apparatus according to claim 1, wherein the adjusting unit sets different references as determination references in the determination unit for the plurality of respective different image forming speeds changed by the speed changing unit.

3. The image forming apparatus according to claim 1, further comprising a storing unit that stores an image forming condition at the first image forming speed, wherein in a case where the determination unit determines not to adjust an image forming condition when the speed changing unit changes the image forming speed to the first image forming speed, the adjusting unit adjusts the image forming condition at the first image forming speed stored in the storing unit and sets the adjusted image forming condition to the image forming unit, before the image forming unit starts forming the image at the changed first image forming speed.

4. The image forming apparatus according to claim 1, wherein in a case where the determination unit determines not to adjust the image forming condition when the speed changing unit changes the image forming speed to the first image forming speed, the adjusting unit calculates the image forming condition on the basis of both a previous image forming condition and a variation of a last image forming condition, and sets the calculated image forming condition to the image forming unit before the image forming unit starts forming the image at the changed image forming speed, the previous image forming condition being the image forming condition set at the first image forming speed prior to the change of the image forming speed, and the last image forming condition being the image forming condition set at the image forming speed set just before the last change to the image forming speed.

5. The image forming apparatus according to claim 1, wherein in a case where the speed changing unit does not change the image forming speed, the adjusting unit adjusts the image forming condition after the measured value indicative of the elapsed state measured by the measuring unit reaches a predetermined value.

6. The image forming apparatus according to claim 1, wherein the adjusting unit adjusts the image forming condition set in the image forming unit, according to a state quantity indicating a state of the image formed on the medium by the image forming unit.

7. A non-transitory computer readable medium storing a program causing a computer to execute a process for adjusting an image forming condition, the process comprising:

obtaining change information indicative of a change of an image forming speed in an image forming unit forming an image on a medium according to an image forming condition;

measuring an elapsed state in the image forming unit and outputting a measured value indicative of the elapsed state using a measuring unit;

determining whether or not the measured value indicative of the elapsed state is not less than a predetermined value using a determination unit, the elapsed state being measured when the change information of the image forming speed is obtained; and adjusting the image forming condition set in the image forming unit, using an adjusting unit, before the image forming unit starts forming the image at the changed image forming speed, in a case where the measured value indicative of the elapsed state is determined to be not less than the predetermined value;

wherein the measuring unit measures the elapsed state after the adjusting unit adjusts the image forming condition, and in a case where the determination unit determines not to adjust the image forming condition when a speed changing unit changes the image forming speed to a first image forming speed, the measuring unit measures a total sum (A+B) of the measured value (A) indicative of the elapsed state at the first image forming speed after the change of the image forming speed, and the measured value (B) indicative of the elapsed state after the last adjustment of the image forming condition at the first image forming speed before the change of the image forming speed, and the adjusting unit adjusts the image forming condition when the total sum reaches a certain value.

8. An image forming condition adjustment method comprising:

obtaining change information indicative of a change of an image forming speed in an image forming unit forming an image on a medium according to an image forming condition;

measuring an elapsed state in the image forming unit and outputting a measured value indicative of the elapsed state using a measuring unit;

determining whether or not the measured value indicative of the elapsed state is not less than a predetermined value using a determination unit, the elapsed state being measured when the change information of the image forming speed is obtained; and adjusting the image forming condition set in the image forming unit, using an adjusting unit, before the image forming unit starts forming the image at the changed image forming speed, in a case where the measured value indicative of the elapsed state is determined to be not less than the predetermined value;

wherein the measuring unit measures the elapsed state after the adjusting unit adjusts the image forming condition, and in a case where the determination unit determines not to adjust the image forming condition when a speed changing unit changes the image forming speed to a first image forming speed, the measuring unit measures a total sum (A+B) of the measured value (A) indicative of the elapsed state at the first image forming speed after the change of the image forming speed, and the measured value (B) indicative of the elapsed state after the last adjustment of the image forming condition at the first image forming speed before the change of the image forming speed, and the adjusting unit adjusts the image forming condition when the total sum reaches a certain value.

* * * * *